US011421418B2

(12) United States Patent
Herbert et al.

(10) Patent No.: US 11,421,418 B2
(45) Date of Patent: Aug. 23, 2022

(54) TRUSS WITH INTEGRATED WIRING

(71) Applicant: UNIVERSAL CITY STUDIOS LLC, Universal City, CA (US)

(72) Inventors: Christopher Michael Herbert, Kissimmee, FL (US); Joshua Prince, Casselberry, FL (US)

(73) Assignee: UNIVERSAL CITY STUDIOS LLC, Universal City, CA (US)

( * ) Notice: Subject to any disclaimer, the term of this patent is extended or adjusted under 35 U.S.C. 154(b) by 0 days.

(21) Appl. No.: 16/723,957

(22) Filed: Dec. 20, 2019

(65) Prior Publication Data

US 2021/0189724 A1 Jun. 24, 2021

(51) Int. Cl.

| | |
|---|---|
| ***E04C 3/08*** | (2006.01) |
| ***H01R 25/00*** | (2006.01) |
| ***H01R 43/26*** | (2006.01) |
| ***H01R 25/14*** | (2006.01) |
| ***E04C 3/04*** | (2006.01) |

(52) U.S. Cl.

CPC ..... *E04C 3/08* (2013.01); *H01R 25/006* (2013.01); *H01R 25/145* (2013.01); *H01R 43/26* (2013.01); *E04C 2003/0413* (2013.01); *E04C 2003/0465* (2013.01)

(58) Field of Classification Search

CPC ... F21S 2/005; F21S 8/02; F21S 8/066; E04C 3/08; E04C 2003/0413; E04C 2003/0465; H01R 25/006; H01R 25/145; H01R 43/26; F21V 21/35; F21W 2131/406

See application file for complete search history.

(56) References Cited

U.S. PATENT DOCUMENTS 3,051,772 A * 8/1962 Davis ..... F21V 21/34 174/61
4,683,677 A 8/1987 Jurgensen
(Continued)

FOREIGN PATENT DOCUMENTS

DE 3808570 A1 * 9/1989
FR 3068795 A1 * 1/2019 ..... F21V 21/35

OTHER PUBLICATIONS

MTX Electrical & Engineering, "Internally Wired Lighting Truss", 2014; 2 pgs.

(Continued)

*Primary Examiner* — Theodore V Adamos
(74) *Attorney, Agent, or Firm* — Loza & Loza, LLP; Lew Edward V. Macapagal

(57) ABSTRACT

Aspects of the disclosure relate to a truss with integrated wiring. A truss with integrated wiring includes a plurality of chords coupled together with a plurality of support members. At least one chord of the plurality of chords includes a hollow space along a length of the at least one chord of the plurality of chords. The truss with integrated wiring further includes a first set of electrical connectors situated near a first end of the at least one chord of the plurality of chords, and a second set of electrical connectors situated near a second end of the at least one chord of the plurality of chords. The first and second set of electrical connectors are outside of the hollow space. The first set of electrical connectors is coupled to the second set of electrical connectors through a set of electrical wires housed in the hollow space.

19 Claims, 13 Drawing Sheets

(56) References Cited

U.S. PATENT DOCUMENTS 6,082,053 A * 7/2000 Bischof ..... E05D 15/0604 49/221
6,233,878 B1 * 5/2001 Krahenbuhl ..... E05F 15/632 52/64
6,470,630 B1 * 10/2002 Miyamoto ..... E04B 1/34807 52/64
6,497,586 B1 * 12/2002 Wilson ..... H01R 13/73 362/383
6,546,677 B1 4/2003 Featherstone
6,773,289 B1 * 8/2004 Chen ..... H01R 13/71 439/159
7,842,885 B2 11/2010 Calleja
8,827,537 B2 9/2014 Bolvi
2002/0109984 A1 8/2002 Bischel et al.
2007/0204520 A1 9/2007 Calleja
2009/0173033 A1 * 7/2009 Baxter, Jr. ..... A63J 1/00 52/646
2009/0201686 A1 * 8/2009 Calleja ..... F21V 21/35 362/431
2009/0201687 A1 * 8/2009 Calleja ..... H01R 25/145 362/431
2010/0219693 A1 9/2010 Azancot et al.
2011/0115402 A1 * 5/2011 Bolvi ..... H05B 47/18 315/291
2013/0155672 A1 * 6/2013 Vo ..... F21V 21/15 362/233
2014/0250820 A1 * 9/2014 Richardson ..... E04C 3/02 52/634
2014/0263866 A1 * 9/2014 Hemmer ..... F21V 21/03 248/58
2015/0159840 A1 * 6/2015 Liu ..... F21S 2/00 362/648
2015/0315786 A1 * 11/2015 Callahan ..... F21S 2/00 52/652.1
2016/0060861 A1 3/2016 Darden
2017/0040933 A1 2/2017 Vogel
2017/0082266 A1 * 3/2017 Ruhland ..... F21S 8/066
2019/0048571 A1 2/2019 Cohen
2019/0097340 A1 * 3/2019 Birkholz ..... F16L 53/38
2021/0172172 A1 * 6/2021 Phillips ..... A63J 1/02

OTHER PUBLICATIONS

International Search Report and Written Opinion, PCT/2020/063674, dated Mar. 10, 2021, 10 pgs.

* cited by examiner

TRUSS WITH INTEGRATED WIRING

TECHNICAL FIELD

The technology discussed below relates generally to a truss, and more specifically to a truss with integrated wiring.

INTRODUCTION

Trusses are typically used to construct structures (also referred to as truss assemblies or truss systems) for mounting equipment (e.g., lights, audio equipment, projectors for displaying content on a projection screen, and/or other suitable equipment) at a variety of locations, such as theaters, arenas, stadiums, convention centers, and amusement parks (e.g., theme parks). For example, a truss assembly may be constructed for an attraction (e.g., a live stage performance) in an amusement park to support lighting equipment, audio speakers, and other equipment that may significantly enhance an experience of viewers.

However, in order to power and/or control the mounted equipment on such truss assemblies, long and heavy cables typically need to be separately installed on the truss assemblies. As truss assemblies are usually large and include portions that are relatively high above the ground (e.g., 6.0 meters above the ground), the process of planning out the cable connections and the physical installation of these cables are often time consuming, difficult, and expensive. Moreover, accounting for the additional weight and possible movement of the cables may increase the complexity of the design and construction of the truss assembly. Finally, it may be difficult and costly to make adjustments to the truss assembly and/or the equipment mounted on the truss assembly after the cables have been installed. For example, such adjustments may frequently require workers to employ man-lifts or harnesses to access elevated portions of the truss assembly, which can increase costs and raise safety concerns.

BRIEF SUMMARY OF SOME EXAMPLES

The following presents a simplified summary of one or more aspects of the present disclosure, in order to provide a basic understanding of such aspects. This summary is not an extensive overview of all contemplated features of the disclosure, and is intended neither to identify key or critical elements of all aspects of the disclosure nor to delineate the scope of any or all aspects of the disclosure. Its sole purpose is to present some concepts of one or more aspects of the disclosure in a simplified form as a prelude to the more detailed description that is presented later.

Aspects of the present disclosure are related to trusses with integrated wiring, truss assemblies with integrated wiring, and methods for constructing trusses with integrated wiring. In some aspects of the disclosure, a truss with integrated wiring includes a plurality of chords coupled together with a plurality of support members, wherein at least one chord of the plurality of chords includes a hollow space along a length of the at least one chord of the plurality of chords. The truss with integrated wiring further includes a first set of electrical connectors situated near a first end of the at least one chord of the plurality of chords, wherein the first set of electrical connectors are outside of the hollow space. The truss with integrated wiring further includes a second set of electrical connectors situated near a second end of the at least one chord of the plurality of chords, wherein the second set of electrical connectors are outside of the hollow space. The first set of electrical connectors is electrically coupled to the second set of electrical connectors through a set of electrical wires housed in the hollow space.

In one example, a truss assembly with integrated wiring is disclosed. The truss assembly includes a first truss including a first set of electrical connectors situated near a first end of the first truss and a second set of electrical connectors situated near a second end of the first truss, the first set of electrical connectors being electrically coupled to the second set of electrical connectors through a first set of electrical wires housed inside a chord of the first truss. The truss assembly further includes a second truss including a third set of electrical connectors situated near a first end of the second truss and a fourth set of electrical connectors situated near a second end of the second truss, the third set of connectors being electrically coupled to the fourth set of electrical connectors through a second set of electrical wires housed inside a chord of the second truss. The second end of the first truss is coupled to the first end of the second truss, and the second set of electrical connectors is electrically coupled to the third set of electrical connectors.

In one example, a method for constructing a truss with integrated wiring is disclosed. The method includes coupling a plurality of chords together with a plurality of support members, wherein at least one chord of the plurality of chords includes a hollow space along a length of the at least one chord of the plurality of chords. The method further includes coupling a first set of electrical connectors near a first end of the at least one chord of the plurality of chords, wherein the first set of electrical connectors is outside of the hollow space. The method further includes coupling a second set of electrical connectors near a second end of the at least one chord of the plurality of chords, wherein the second set of electrical connectors is outside of the hollow space. The method further includes coupling the first set of electrical connectors to the second set of electrical connectors through a set of electrical wires housed in the hollow space of the at least one chord of the plurality of chords.

DETAILED DESCRIPTION

The detailed description set forth below in connection with the appended drawings is intended as a description of various configurations and is not intended to represent the only configurations in which the concepts described herein may be practiced. The detailed description includes specific details for the purpose of providing a thorough understanding of various concepts. However, it will be apparent to those skilled in the art that these concepts may be practiced without these specific details. In some instances, well known structures and components are shown in block diagram form in order to avoid obscuring such concepts. While aspects and embodiments are described in this application by illustration to some examples, those skilled in the art will understand that additional implementations and use cases may come about in many different arrangements and scenarios. Innovations described herein may be implemented across many differing platform types, devices, systems, shapes, sizes, and/or packaging arrangements.

Figure 1:
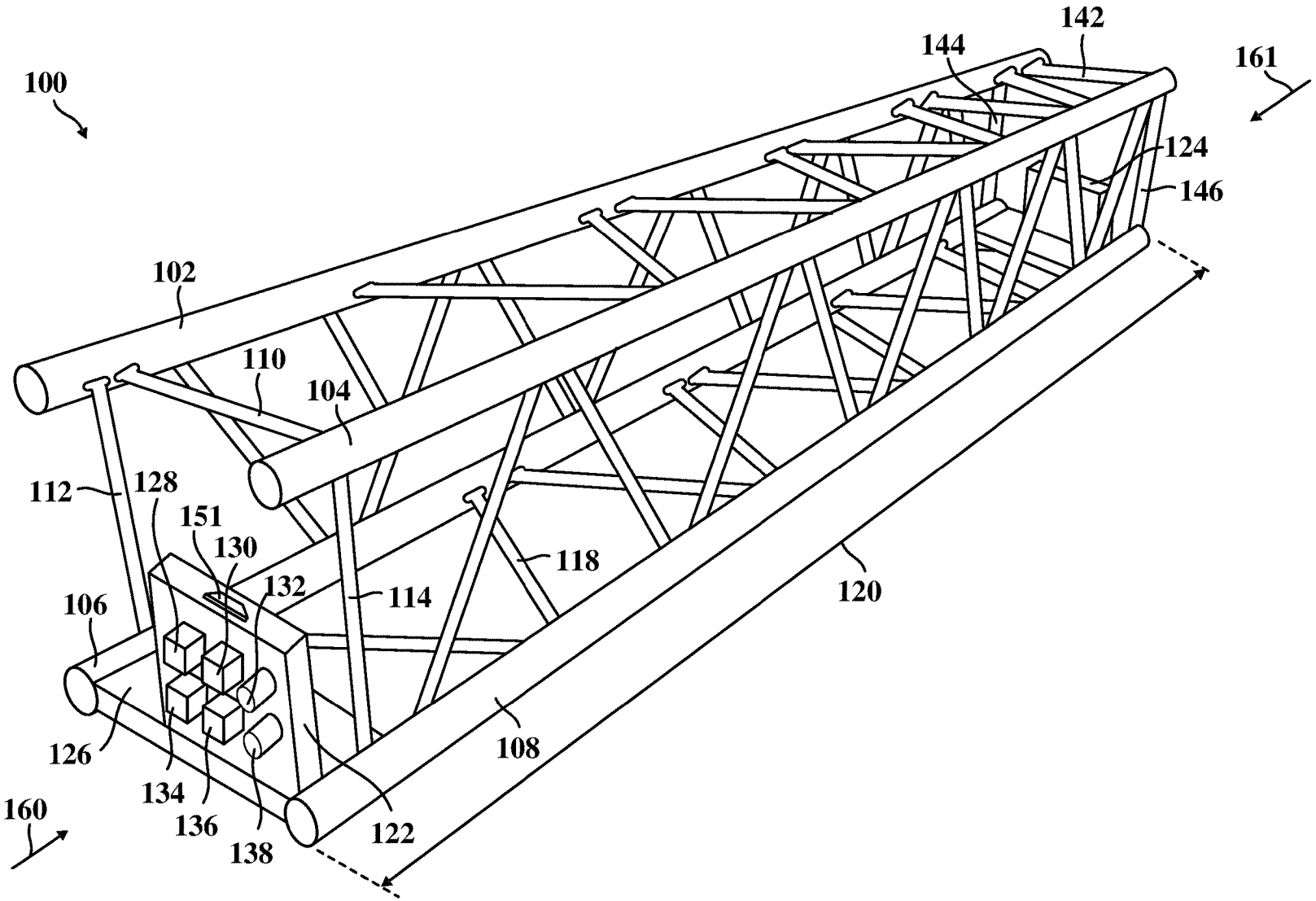
FIG. 1 is a front perspective view of a truss with integrated wiring in accordance with various aspects of the disclosure.

Aspects of the present disclosure are related to trusses with integrated wiring, truss assemblies with integrated wiring, and methods for constructing trusses with integrated wiring. FIG. 1 is a front perspective view of a truss 100 with integrated wiring in accordance with various aspects of the disclosure. As shown in FIG. 1, the truss 100 may include chords 102, 104, 106, and 108 and a number of support members coupled to the chords 102, 104, 106, and 108. For example, and as shown in FIG. 1, the chords 102 and 104 may be coupled together with at least straight support members 110 and 142, the chords 102 and 106 may be coupled together with at least straight support members 112 and 144, the chords 104 and 108 may be coupled together with at least straight support members 114 and 146. In some examples, the chords 106 and 108 may be coupled together with straight support members (not shown in FIG. 1) similar to the straight support members 110 and 142. In some aspects of the disclosure, as shown in FIG. 1, the chords 102, 104, 106, and/or 108 may be further coupled together with one or more diagonal support members, such as diagonal support member 118.

In some aspects of the disclosure, each of the chords 102, 104, 106, and 108 may have approximately a same length 120 and may be oriented in parallel with respect to one another. In some examples, the length 120 may be in the range of 90 centimeters (cm) to 370 cm. However, it should be understood that the length 120 may be less than 90 cm or greater than 370 cm in other examples. In some examples, each of the chords 102, 104, 106, and 108 and each of the support members (e.g., support members 114, 118) may have a tubular shape and may be formed using a rigid material, such as steel, aluminum, or other suitable material. In FIG. 1, for example, the chord 108 may be a steel tube with a hollow space that extends along the length 120. For example, the chords 102, 104, 106, and 108 may each have approximately a same outside tube diameter and approximately a same inside tube diameter.

As shown in FIG. 1, the truss 100 may include connector interfaces 122 and 124 situated at opposite ends of the truss 100 (e.g., a first end 160 and a second end 161). The connector interface 122 may include a first set of connectors and the connector interface 124 may include a second set of connectors. In some aspects of the disclosure, the connector interface 122 may include a latch locking mechanism 151. In some aspects of the disclosure, the connector interface 122 may be situated on a mounting unit 126 extending between the chords 106 and 108. For example, the mounting unit 126 may be formed of steel, aluminum, or other rigid material suitable for supporting the connector interface 124. For example, as shown in FIG. 1, the first set of connectors of the connector interface 122 may include male connectors 128, 130, 132, 134, 136, and 138.

In some aspects of the disclosure, the first set of connectors may include different types of connectors configured for different purposes. For example, some of the male connectors (e.g., the male connectors 132, 138 having a circular shape) of the connector interface 122 may be configured for transferring an electrical power (e.g., an alternating current (AC) electrical power), while other male connectors (e.g., the male connectors 128, 130, 134, 136 having a rectangular shape) of the connector interface 122 may be configured for transferring data signals (e.g., video signals, audio signals, audio/visual signals, media signals, etc.), control signals (e.g., analog or digital control signals), networking signals, and/or other suitable signals. In the aspects described herein, connectors configured for transferring the electrical power (e.g., the male connector 138 and female connector 238) may also be referred to as power connectors. As described in greater detail with reference to FIGS. 2-6, each of the first set of connectors of the connector interface 122 may be electrically coupled to a corresponding connector in the second set of connectors of the connector interface 124 through a set of wires (e.g., a set of wires 340 shown in FIG. 3). The set of wires 340 may be housed within the previously described hollow space of the chord 108 and may extend along the length 120.

Figure 2:
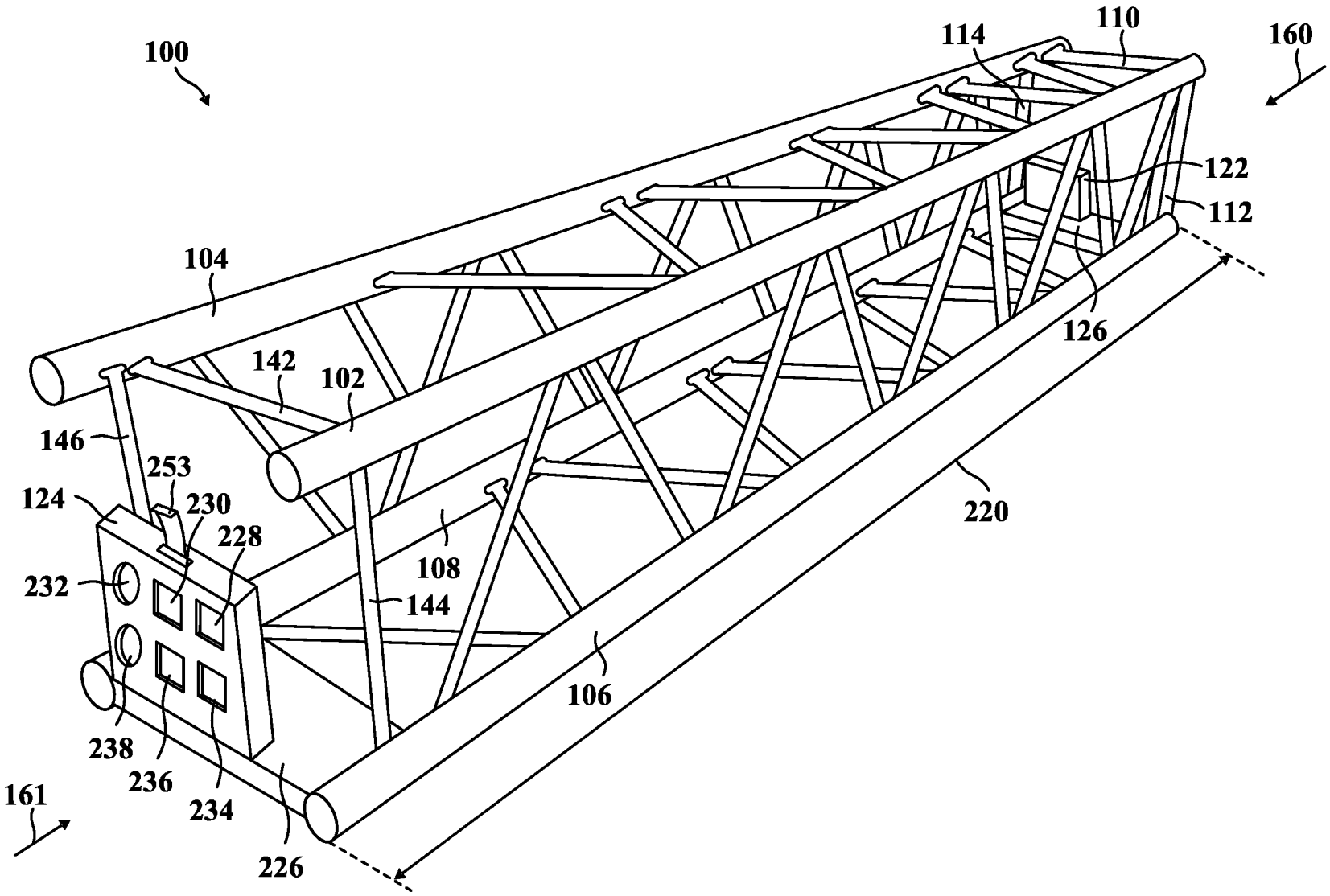
FIG. 2 is a rear perspective view of the truss with integrated wiring in accordance with various aspects of the disclosure.

FIG. 2 is a rear perspective view of the truss 100 with integrated wiring in accordance with various aspects of the disclosure. As shown in FIG. 2, the second set of connectors of the connector interface 124 may include female connectors 228, 230, 232, 234, 236, and 238. In some aspects of the disclosure, the second set of connectors may include different types of connectors that are configured for different purposes. For example, some of the female connectors (e.g., the female connectors 232, 238 having a circular shape) of the connector interface 124 may be configured for transferring the electrical power (e.g., the AC electrical power), while other female connectors (e.g., the female connectors 228, 230, 234, 236 having a rectangular shape) of the connector interface 124 may be configured for transferring data signals (e.g., video signals, audio signals, audio/visual signals, media signals, etc.), control signals (e.g., analog or digital control signals), networking signals, and/or other suitable signals. In some aspects of the disclosure, the connector interface 124 may include a latch 253.

In some aspects of the disclosure, the connector interface 124 may be installed on a mounting unit 226 extending between the chords 106, 108. For example, the mounting unit 226 may be formed of steel, aluminum, or other rigid material suitable for supporting the connector interface 124.

In some aspects of the disclosure, a position of the connector interface 122 on the mounting unit 126 and/or a position of the connector interface 124 on the mounting unit 226 may be user adjustable. For example, the position of the connector interface 122 may be adjusted in a lateral direction along the mounting unit 126 and/or in a back and forth direction on the mounting unit 126. Similarly, the position of the connector interface 124 may be adjusted in a lateral direction along the mounting unit 226 and/or in a back and forth direction on the mounting unit 226.

Figure 3:
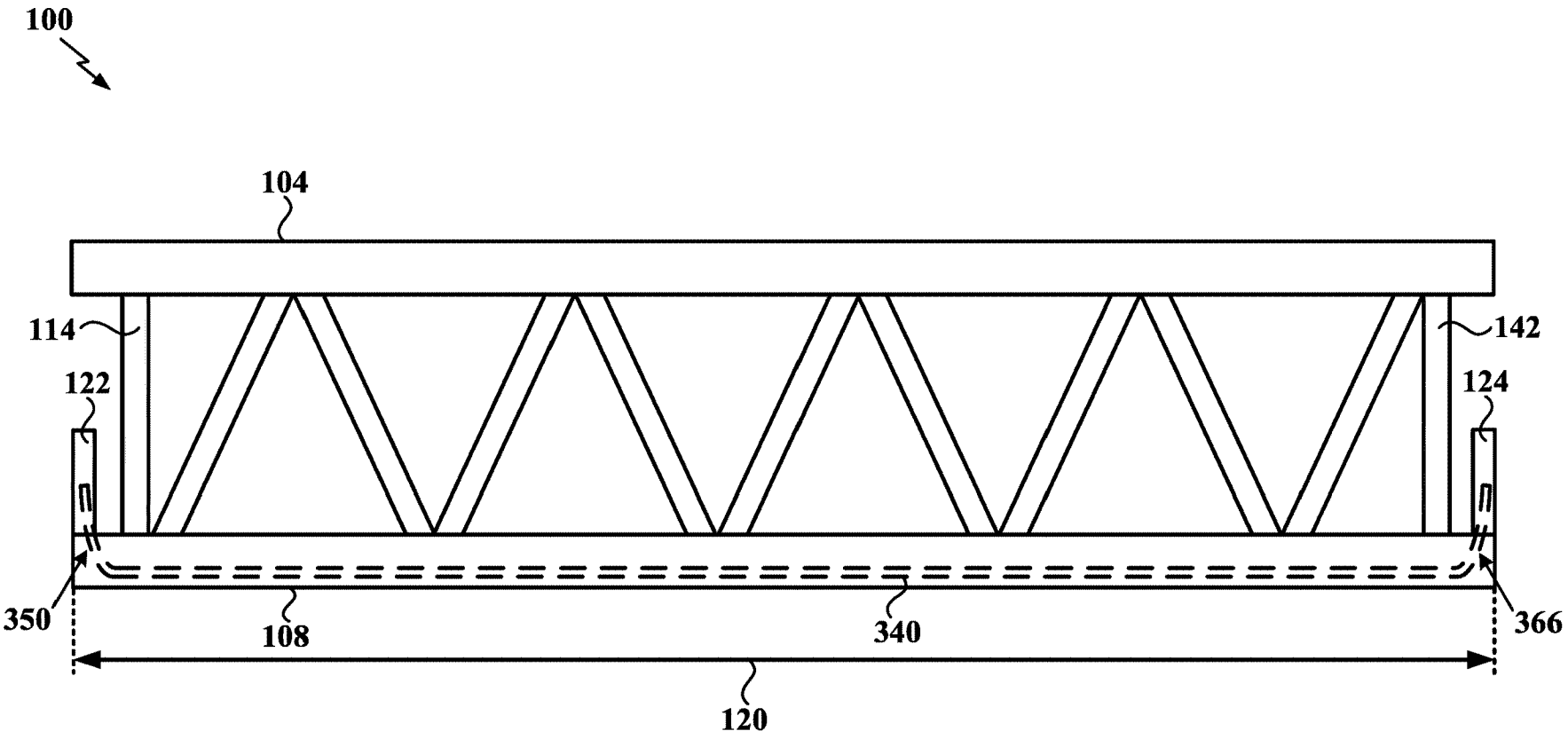
FIG. 3 shows a side view of the truss with integrated wiring in accordance with various aspects of the disclosure.

FIG. 3 shows a side view of the truss 100 in accordance with various aspects of the disclosure. As shown in FIG. 3, the previously described set of wires 340 (indicated with dashed lines in FIG. 3) may be housed in the hollow space (e.g., a hollow space 464 shown in FIG. 4) of the chord 108. In the example implementation of FIG. 3, a section of the set of wires 340 extending between a first portion 350 and a second portion 366 is housed in the hollow space (e.g., the hollow space 464 shown in FIG. 4) of the chord 108. In some aspects of the disclosure, the chord 108 may include holes (or other suitable openings) through a surface of the chord 108 near the connector interfaces 122, 124. Such holes may be used to run the set of wires 340 in/out of the hollow space of the chord 108.

Figure 4:
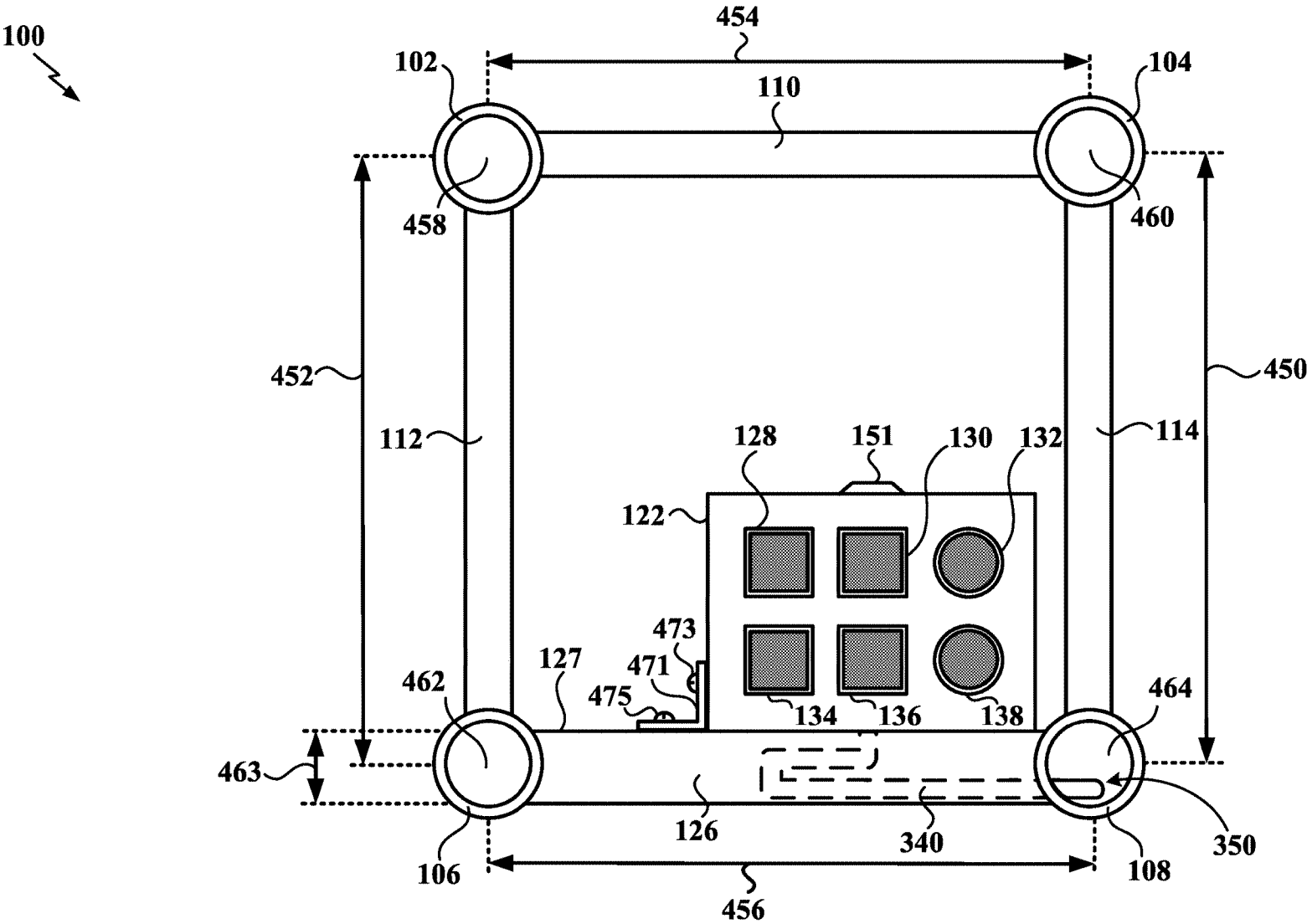
FIG. 4 shows a view of the first end of the truss with integrated wiring in accordance with various aspects of the disclosure.

FIG. 4 shows a view of the first end (e.g., the first end 160) of the truss 100 with integrated wiring in accordance with various aspects of the disclosure. As shown in FIG. 4, the chords 104 and 108 may be spaced apart by a first center-to-center distance 450, and the chords 102 and 106 may be spaced apart by a second center-to-center distance 452. For example, the first center-to-center distance 450 may be approximately equal to the second center-to-center distance 452. As further shown in FIG. 4, the chords 102 and 104 may be spaced apart by a third center-to-center distance 454, and the chords 106 and 108 may be spaced apart by a fourth center-to-center distance 456. For example, the third center-to-center distance 454 may be approximately equal to the fourth center-to-center distance 456.

In the aspect of FIG. 4, the connector interface 122 may be coupled to the mounting unit 126 via a bracket 471 and first and second screws 473, 475. For example, the position of the connector interface 122 may be adjusted by loosening the first and/or second screws 473, 475, moving the connector interface 122 into a desired position on the mounting unit 126, and tightening the first and/or second screws 473, 475 to secure the connector interface 122 in place. In some aspects of the disclosure, the mounting unit 126 may be configured to slide back and forth between the chords 106, 108. These aspects are explained in further detail with reference to FIG. 8.

As shown in FIG. 4, the mounting unit 126 may include a cavity that provides sufficient space to house at least a portion of the set of wires 340. In FIG. 4, for example, the portion of the set of wires 340 housed in the mounting unit 126 is indicated with dotted lines. As shown in FIG. 4, the mounting unit 126 may have a width 463. In some aspects of the disclosure, the width 463 may be based on the amount of space needed to house a portion of the set of wires 340. In some examples, the width 463 may be in the range of 15 cm to 45 cm. However, it should be understood that the width 463 may be less than 15 cm or greater than 45 cm in other examples. In some aspects of the disclosure, the portion of the set of wires 340 housed in the mounting unit 126 may be enclosed in a flexible cable carrier (also referred to as a cable track) or other suitable conduit.

As previously described, each of the chords 102, 104, 106, and 108 may have a tubular shape (e.g., a hollow cylinder shape). Accordingly, as shown in FIG. 4, the chords 102, 104, 106, and 108 may each have a circular cross section and may include a hollow space (e.g., hollow space 458, 460, 462, 464) that extends along the length (e.g., the length 120) of each chord. As further shown in FIG. 4, the set of wires 340 may be fed from inside the mounting unit 126 to the hollow space 464 of the chord 108. As previously described, the chord 108 may include a first hole (or other suitable openings adjacent to the mounting unit 126) through the surface of the chord 108 to enable feeding of the set of wires 340 into the hollow space 464. In FIG. 4, the first portion 350 of the set of wires 340 is shown to be housed in the hollow space 464 of the chord 108.

Figure 5:
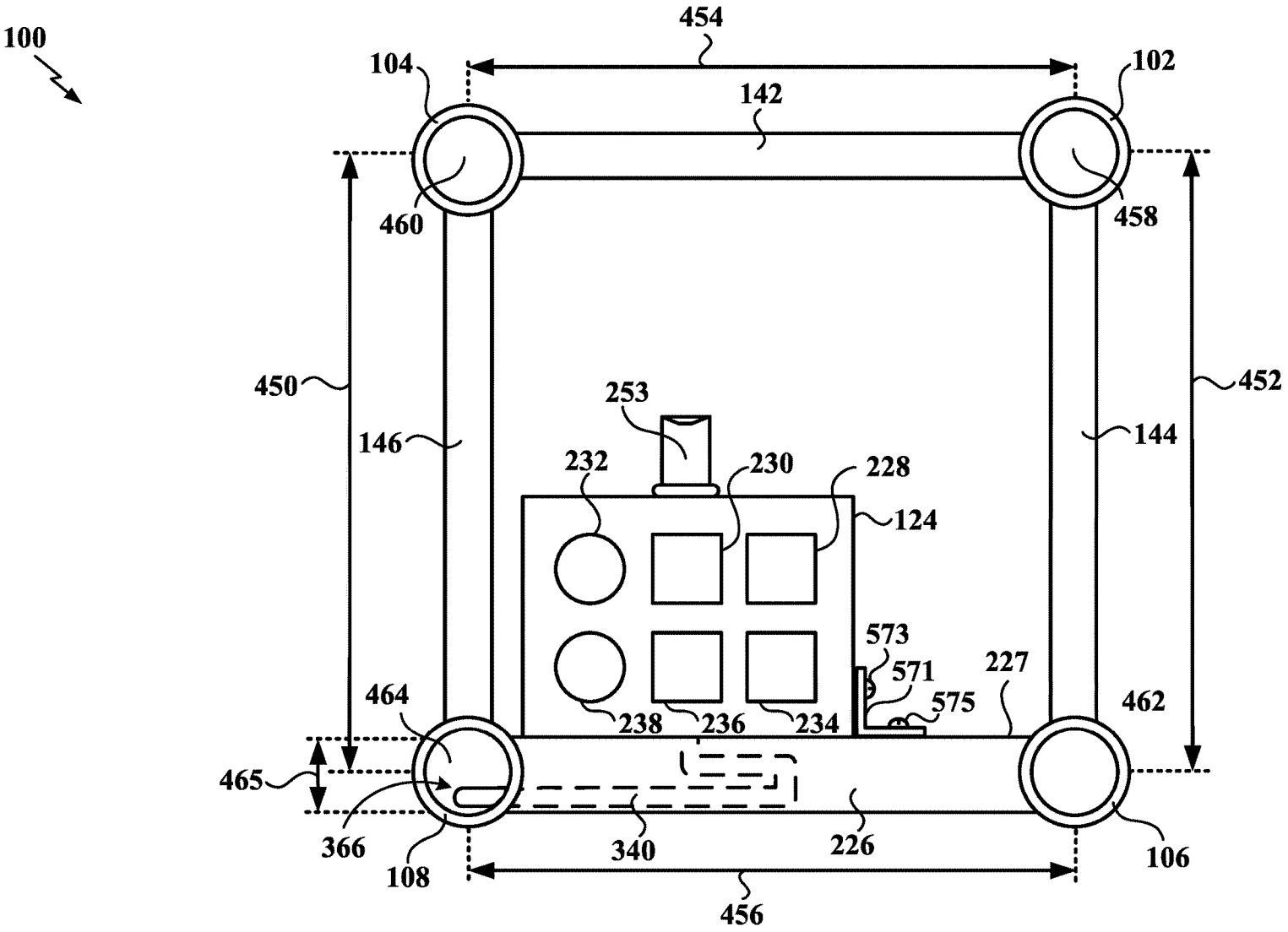
FIG. 5 shows a view of the second end of the truss with integrated wiring in accordance with various aspects of the disclosure.

FIG. 5 shows a view of the second end (e.g., the second end 161) of the truss 100 with integrated wiring in accordance with various aspects of the disclosure. In the aspect of FIG. 5, the connector interface 124 may be coupled to the mounting unit 226 via a bracket 571 and first and second screws 573, 575. For example, the position of the connector interface 124 may be adjusted by loosening the first and/or second screws 573, 575, moving the connector interface 124 into a desired position on the mounting unit 226, and tightening the first and/or second screws 573, 575 to secure the connector interface 124 in place. In some aspects of the disclosure, the mounting unit 226 may be configured to slide back and forth between the chords 106, 108. These aspects are explained in further detail with reference to FIG. 8.

As shown in FIG. 5, the mounting unit 226 may include a cavity that provides sufficient space to house at least a portion of the set of wires 340. In FIG. 5, for example, the portion of the set of wires 340 housed in the mounting unit 226 is indicated with dotted lines. As shown in FIG. 5, the mounting unit 226 may have a width 465. In some aspects of the disclosure, the width 465 may be based on the amount of space needed to house a portion of the set of wires 340. In some examples, the width 465 may be in the range of 15 cm to 45 cm. In other examples, the width 465 may be less than 15 cm or greater than 45 cm. In some aspects of the disclosure, the portion of the set of wires 340 housed in the mounting unit 226 may be enclosed in a flexible cable carrier (also referred to as a cable track) or other suitable conduit.

As further shown in FIG. 5, the set of wires 340 may be fed from the hollow space 464 of the chord 108 to inside the mounting unit 226. As previously described, the chord 108 may include a second hole (or other suitable openings adjacent to the mounting unit 226) through the surface of the chord 108 to enable feeding of the set of wires 340 into the mounting unit 226. In FIG. 5, the second portion 366 of the set of wires 340 is shown to be housed in the hollow space 464 of the chord 108.

Figure 6:
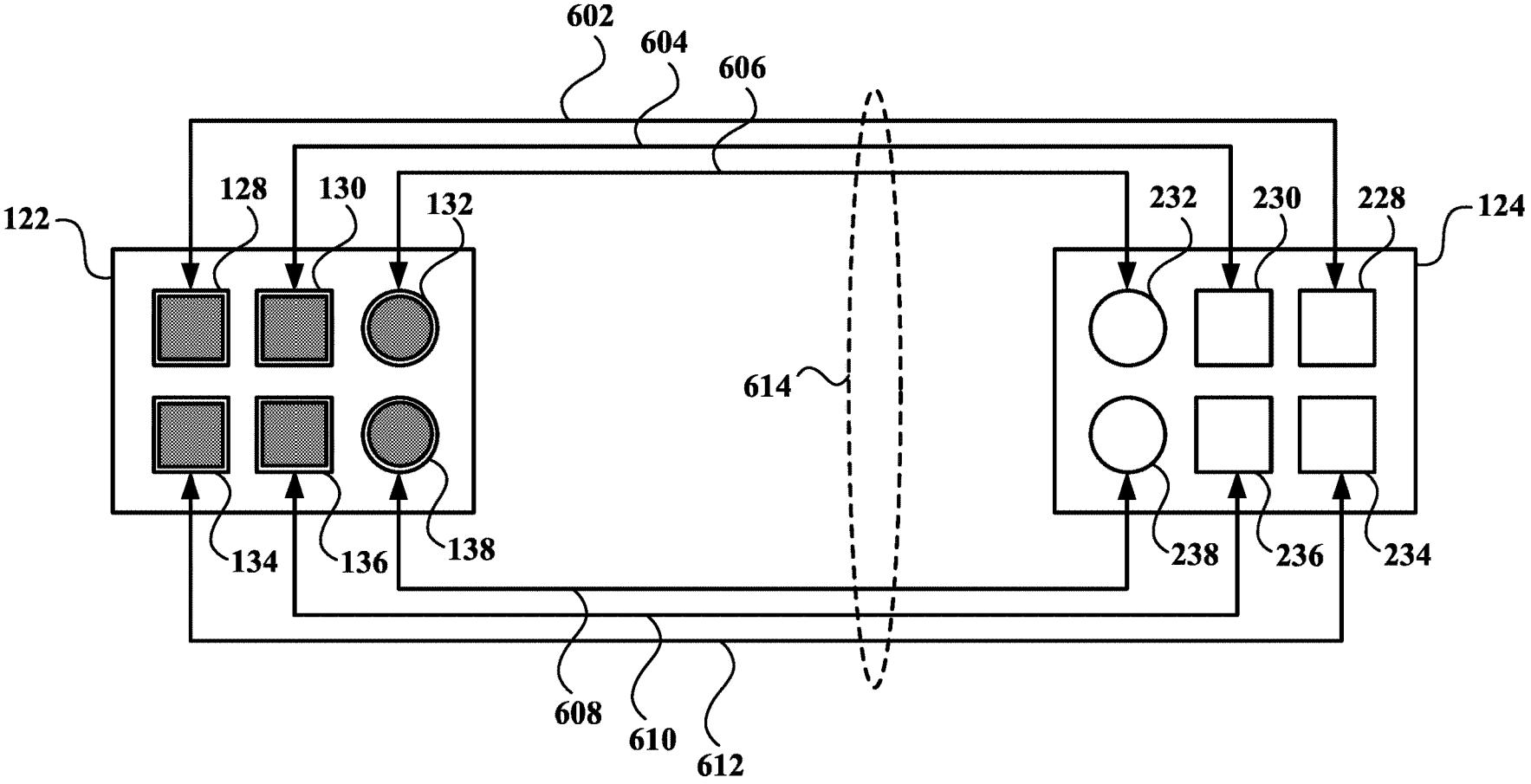
FIG. 6 is a block diagram showing the coupling between a first set of connectors of a connector interface and a second set of connectors of another connector interface in accordance with various aspects of the disclosure.

FIG. 6 is a block diagram showing the coupling between the first set of connectors of the connector interface 122 and the second set of connectors of the connector interface 124 in accordance with various aspects of the disclosure. As shown in FIG. 6, the male connectors 128, 130, 132, 134, 136, and 138 of the first set of connectors may be respectively coupled (e.g., electrically coupled) to the female connectors 228, 230, 232, 234, 236, and 238 of the second set of connectors via respective conductive paths 602, 604, 606, 608, 610, and 612 (also collectively referred to as a set of conductive paths 614). In some aspects of the disclosure, the set of conductive paths 614 may be implemented as the previously described set of wires 340. For example, each conductive path in FIG. 6 (e.g., conductive path 602) may be implemented as one or more wires in the set of wires 340.

In FIG. 6, although each male connector of the connector interface 122 is shown electrically coupled to a corresponding female connector of the connector interface 124 using a single conductive path, it should be understood that a male connector and a corresponding female connector may be electrically coupled with two or more conductive paths (e.g., two or more wires) in other aspects of the disclosure. In one example, the male connector 138 may include two electrical contacts designated as hot and neutral contacts for transfer of the AC electrical power. Similarly, in this example, the corresponding female connector 238 may include two electrical contacts designated as hot and neutral contacts for transfer of the AC electrical power. Accordingly, a first conductive path may be used to couple the hot contacts of the male and female connectors 138, 238, and a second conductive path may be used to couple the neutral contacts of the male and female connectors 138, 238.

Figure 7:
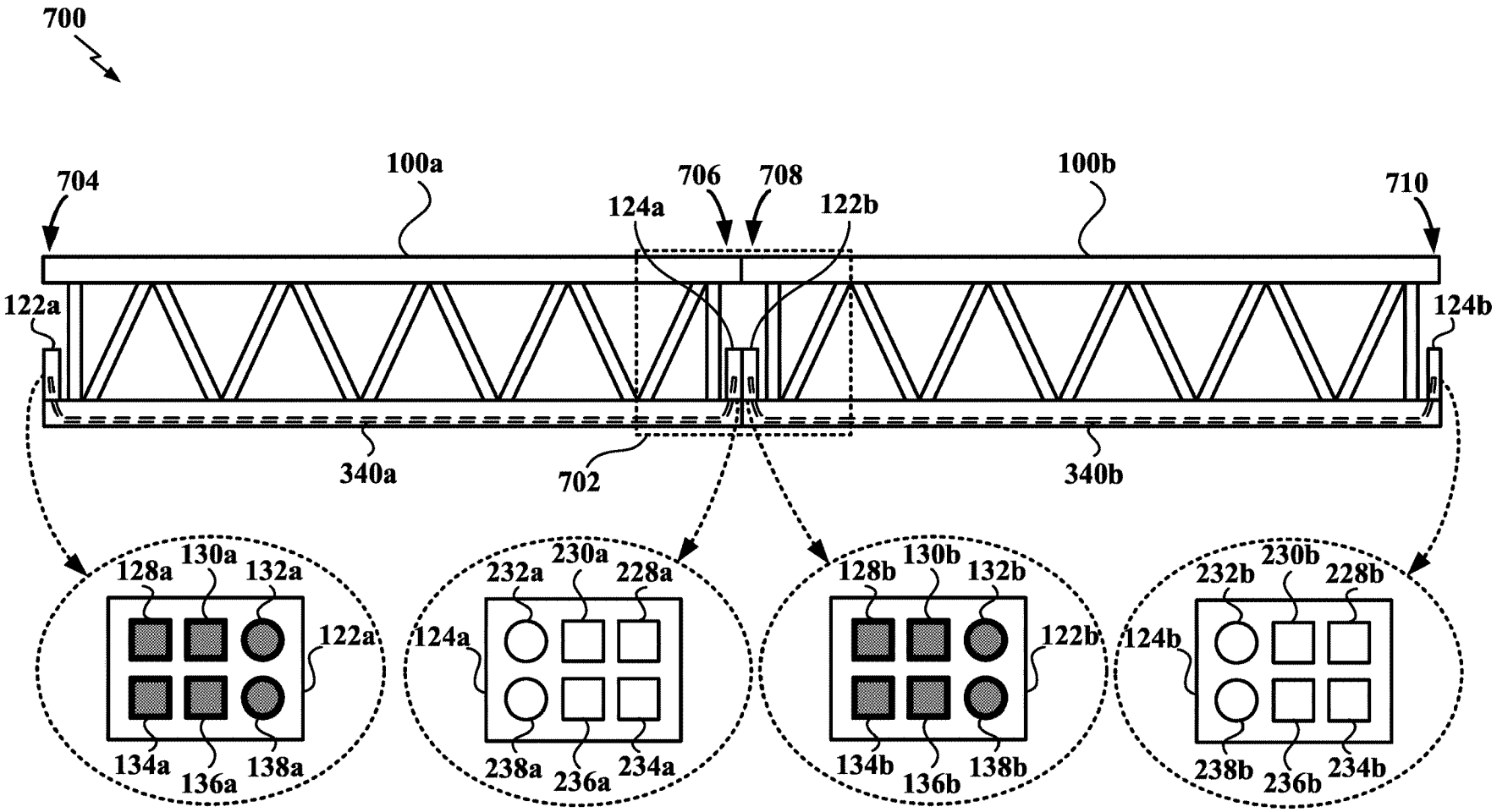
FIG. 7 shows a side view of a truss assembly including first and second trusses with integrated wiring in accordance with various aspects of the disclosure.

FIG. 7 shows a side view of a truss assembly 700 including first and second trusses with integrated wiring in accordance with various aspects of the disclosure. As shown in FIG. 7, the truss assembly 700 includes a first truss 100*a* having first and second ends 704, 706, and a second truss 100*b* having first and second ends 708, 710. In some aspects of the disclosure, the first truss 100*a* and the second truss 100*b* may both be the same as the previously described truss 100 with integrated wiring. In these aspects of the disclosure, the first truss 100*a* may include connector interfaces 122*a*, 124*a* configured similar to the respective connector interfaces 122, 124 of the truss 100, and the second truss 100*b* may include connector interfaces 122*b*, 124*b* configured similar to the respective connector interfaces 122, 124 of the truss 100.

In FIG. 7, the set of connectors included in each of the connector interfaces 122*a*, 124*a*, 122*b*, 124*b* are shown within dotted ovals below the truss assembly 700 for reference. For example, the set of connectors of the connector interface 122*a* may include male connectors 128*a*, 130*a*, 132*a*, 134*a*, 136*a*, and 138*a*, the set of connectors of the connector interface 124*a* may include female connectors 228*a*, 230*a*, 232*a*, 234*a*, 236*a*, and 238*a*, the set of connectors of the connector interface 122*b* may include male connectors 128*b*, 130*b*, 132*b*, 134*b*, 136*b*, and 138*b*, and the set of connectors of the connector interface 124*b* may include female connectors 228*b*, 230*b*, 232*b*, 234*b*, 236*b*, and 238*b*. In FIG. 7, each of the male connectors of the connector interface 122*a* may be electrically coupled to a corresponding female connector of the connector interface 124*a* through a set of wires 340*a*, and each of the male connectors of the connector interface 122*b* may be electrically coupled to a corresponding female connector of the connector interface 124*b* through a set of wires 340*b*.

As shown in FIG. 7, the truss assembly 700 may be formed by coupling the second end 706 of the first truss 100*a* to the first end 708 of the second truss 100*b*. In doing so, the male connectors of the connector interface 122*b* (e.g., the male connectors 128*b*, 130*b*, 132*b*, 134*b*, 136*b*, and 138*b*) may mate with the corresponding female connectors of the connector interface 124*a* (e.g., the female connectors 228*a*, 230*a*, 232*a*, 234*a*, 236*a*, and 238*a*). The term "mate" as used herein refers to the coupling of a male connector with a corresponding female connector so as to form an electrical connection between the male and female connectors. Therefore, once the male connectors of the connector interface 122*b* mate with the corresponding female connectors of the connector interface 124*a*, the male connectors of the connector interface 122*a* may become electrically coupled to the corresponding female connectors of the connector interface 124*b*. For example, the male connectors 128*a*, 130*a*, 132*a*, 134*a*, 136*a*, and 138*a* may be electrically coupled to the respective female connectors 228*b*, 230*b*, 232*b*, 234*b*, 236*b*, and 238*b* through the set of wires 340*a* and the set of wires 340*b*.

Figure 8:
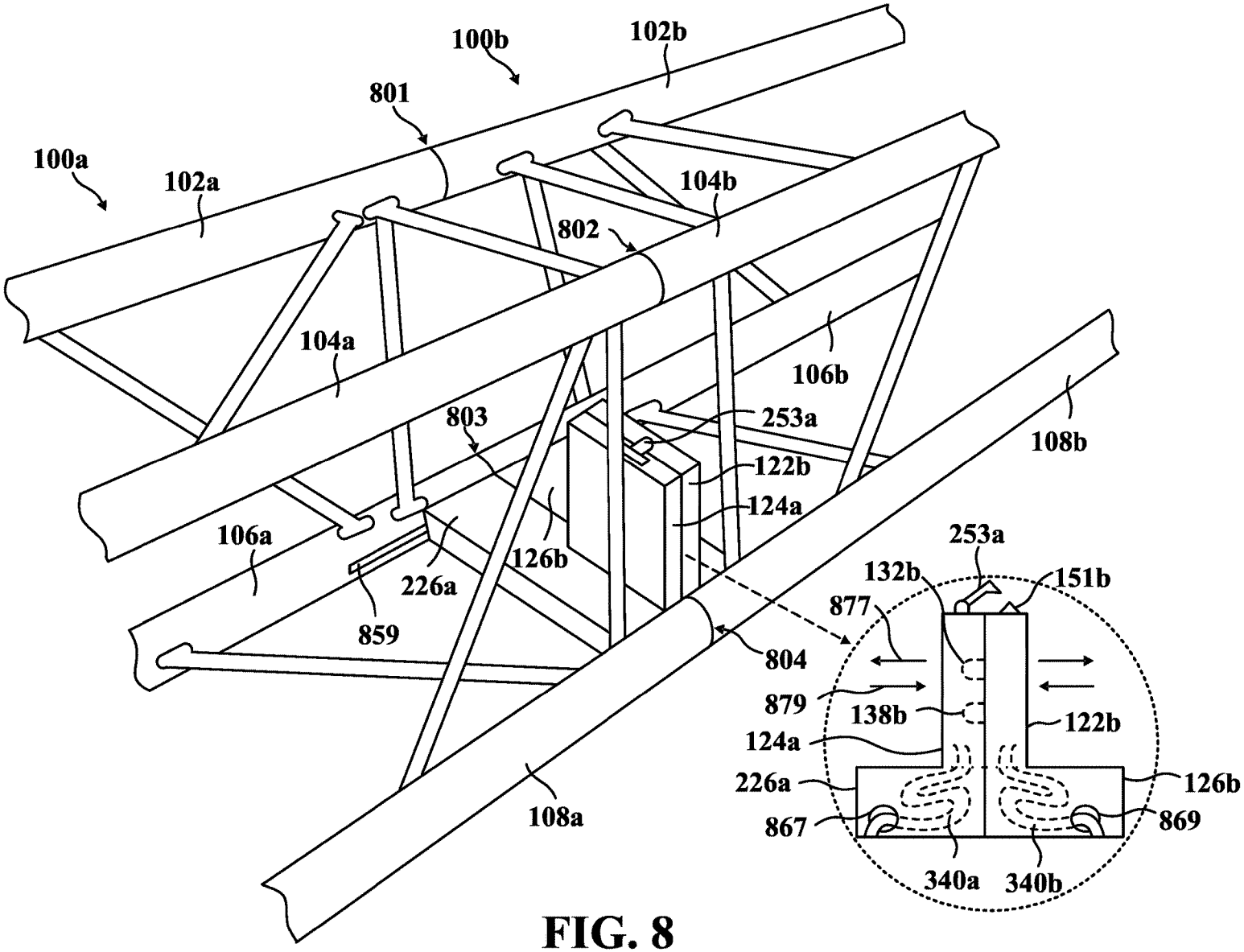
FIG. 8 is a perspective view of the junction section of the truss assembly shown in FIG. 7 in accordance with various aspects of the disclosure.

FIG. 8 is a perspective view of a junction section 702 of the truss assembly 700 shown in FIG. 7 in accordance with various aspects of the disclosure. As shown in FIG. 8, the first truss 100*a* may be coupled to the second truss 100*b* at chord junctions 801, 802, 803, and 804. In some examples, the first truss 100*a* may be coupled to the second truss 100*b* using one or more clamps, connectors, connector plates, adapters, spigots, fasteners (not shown), and/or any other device(s) at or near the chord junctions 801, 802, 803, and 804, to securely couple the chords 102*a*, 104*a*, 106*a*, 108*a* of the truss 100*a* to the respective chords 102*b*, 104*b*, 106*b*, 108*b* of the truss 100*b*.

In some aspects of the disclosure, the chords 106*a*, 108*a* may include grooves (e.g., groove 859) that enable a mounting unit 226*a* of the first truss 100*a* to slide in a back and forth direction along the lengths of the chords 106*a*, 108*a*. The chords 106*b*, 108*b* may include similar grooves that enable a mounting unit 126*b* of the second truss 100*b* to slide in a back and forth direction along the lengths of the chords 106*b*, 108*b*. For example, as shown in the side view of the connector interfaces 124*a*, 122*b* and the mounting units 226*a*, 126*b* within the dotted circle in FIG. 8, the mounting unit 226*a* may slide in a backward direction 877 or a forward direction 879. The mounting unit 126*b* may similarly slide in a backward direction or a forward direction. For example, once the mounting unit 226*a* is in a desired position, the mounting unit 226*a* may be secured in the desired position using a fastener, such as a wingnut, thumb screw, or other suitable fastener. A desired position of the mounting unit 126*b* may be secured in a manner similar to the mounting unit 226*a*.

The previously described features enabling the mounting units 226*a*, 126*b* to slide in the back and forth directions may facilitate mating of the connector interface 124*a* and the connector interface 122*b* after the first truss 100*a* is coupled to the second truss 100*b*. In some aspects of the disclosure, a latch 253*a* on the connector interface 124*a* may be used to attach the connector interface 124*a* to the connector interface 122*b*. A locking mechanism 151*b* on the connector interface 122*b* may hold the latch 253*a* in place.

In some aspects of the disclosure, and as shown in FIG. 8, the portion of the set of wires 340*a* housed in the mounting unit 226*a* (e.g., indicated with dotted lines in the mounting unit 226*a*) may be fed out of a hole 867 in the mounting unit 226*a* and fed into the hollow space of the chord 108*a*. Similarly, the portion of the set of wires 340*a* housed in the mounting unit 126*b* (e.g., indicated with dotted lines in the mounting unit 126*b*) may be fed out of a hole 869 in the mounting unit 126*b* and fed into the hollow space of the chord 108*b*. Therefore, in some aspects of the disclosure, no portion of the set of wires 340*a* or 340*b* may be exposed.

Figure 9:
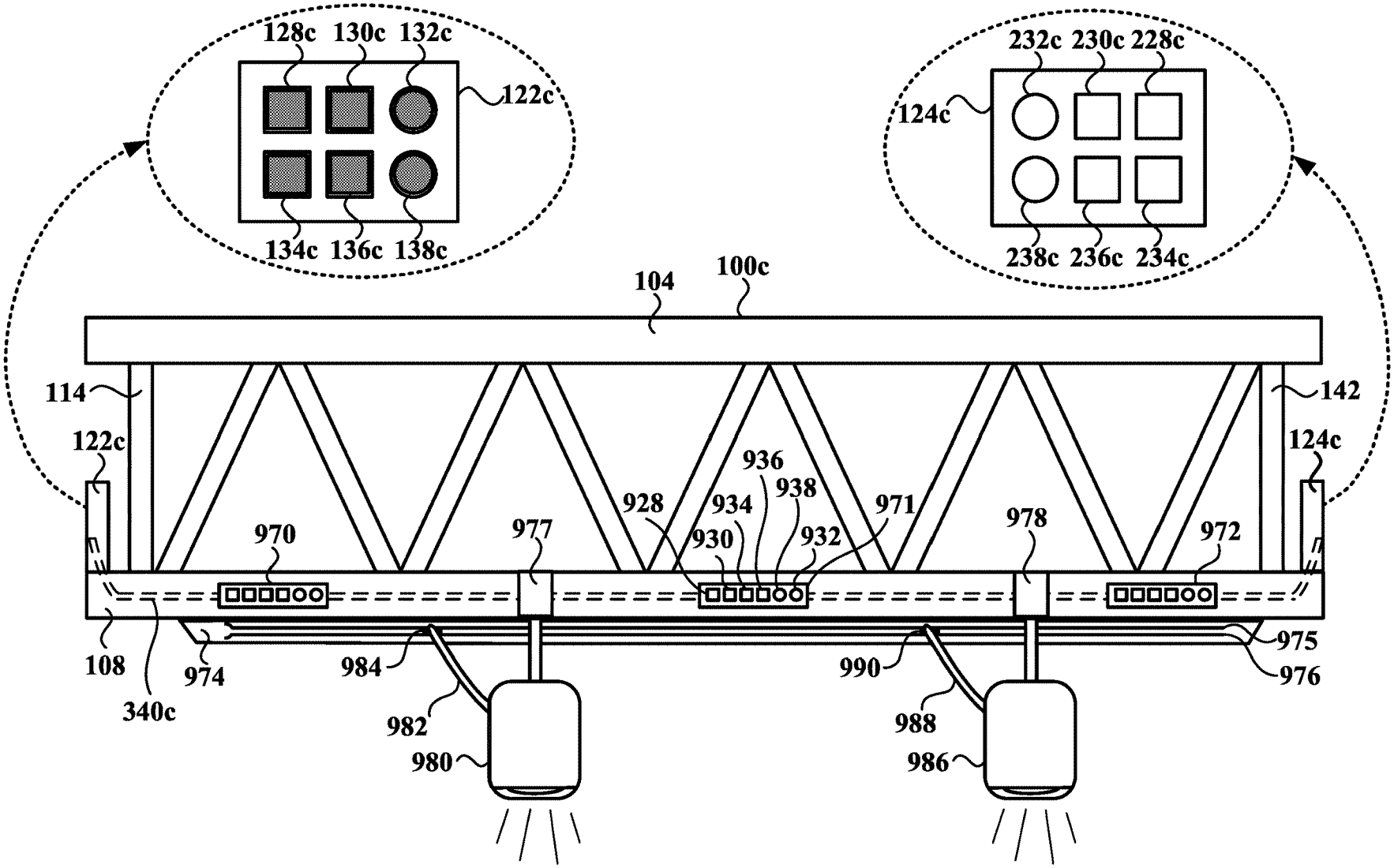
FIG. 9 is a side view of a truss with integrated wiring including an access rail and first and second equipment in accordance with various aspects of the disclosure.

FIG. 9 is a side view of a truss 100*c* with integrated wiring including an access rail 974 and first and second equipment 980, 986 in accordance with various aspects of the disclosure. In FIG. 9, the set of connectors included in each of connector interfaces 122*c*, 124*c* are shown within dotted ovals above the truss 100*c* for reference. For example, and as shown in FIG. 9, the set of connectors of the connector interface 122*c* may include male connectors 128*c*, 130*c*, 132*c*, 134*c*, 136*c*, and 138*c*, and the set of connectors of the connector interface 124*c* may include corresponding female connectors 228*c*, 230*c*, 232*c*, 234*c*, 236*c*, and 238*c*. For example, the male connectors 128*c*, 130*c*, 132*c*, 134*c*, 136*c*, and 138*c* may be electrically coupled to the respective female connectors 228*c*, 230*c*, 232*c*, 234*c*, 236*c*, and 238*c* through a set of wires (e.g., set of wires 340) housed in the hollow space of the chord 108.

As shown in FIG. 9, the access rail 974 may be coupled to the chord 108 of the truss 100*c*. In one example implementation, the access rail 974 may include two parallel tracks 975, 976. In some aspects of the disclosure, the two parallel tracks 975, 976 may be conductive and configured for transferring the electrical power (e.g., the AC electrical power). In some aspects of the disclosure, the set of wires 340*c* in the chord 108 may include wires designated as hot and neutral wires for transferring the electrical power. These hot and neutral wires may be accessed through an opening in the chord 108 and electrically coupled to the respective tracks 975, 976 of the access rail 974. In one example, the male connector 138*c* may include contacts (e.g., a hot contact and a neutral contact) for receiving the electrical power. These contacts may be electrically coupled to the previously described wires designated as hot and neutral wires in the set of wires 340*c* to provide the electrical power to the access rail 974.

As further shown in FIG. 9, the first and second equipment 980 and 986 may be mounted on the truss 100*c*. In the example implementation of FIG. 9, the first and second equipment 980, 986 may be lighting equipment (e.g., stage lights) that operate on AC power. In other implementations, the equipment 980, 986 may be audio equipment (e.g., speakers). For example, the first and second equipment 980, 986 may be coupled to the chord 108 at desired locations via respective clamps 977, 978. First and second electrical cables 982, 988 of the first and second equipment 980, 986 may be coupled to the access rail 974 (e.g., to the parallel tracks 975, 976 of the access rail 974) to enable transfer of the electrical power and operation of the first and second equipment 980, 986. As shown in the example implementation of FIG. 9, the first electrical cable 982 may be electrically connected to a sliding contact device 984. The sliding contact device 984 may be inserted between the parallel tracks 975, 976 and may maintain contact with the parallel tracks 975, 976 as the sliding contact device 984 is being slid into a desired position along the access rail 974. Similarly, the second electrical cable 988 of the second equipment 986 may be electrically connected to a sliding contact device 990, which may be inserted between the parallel tracks 975, 976 and slid into a desired position along the access rail 974. In some aspects of the disclosure, the sliding contact device 984 and/or the sliding contact device 990 may also serve as a structural attachment device for equipment (e.g., to mechanically couple the equipment to the truss 100*c*).

In some aspects of the disclosure, the two parallel tracks 975, 976 of the access rail 974 may not be configured to carry the electrical power for delivery to the equipment coupled to the truss 100*c*. In these aspects, the access rail 974 may be used to mount and conveniently move the equipment along the access rail 974. Accordingly, the access rail 974 may serve as a mechanical coupling device for coupling one or more items of equipment to the truss 100*c*. For example, the equipment may be unclamped (e.g., loosened) from the access rail 974 (e.g., while still being mechanically coupled to the access rail 974), slid into a new position along the access rail 974, and then re-clamped to the access rail 974 to secure the equipment at the new position. In some aspects of the disclosure where the two parallel tracks 975, 976 of the access rail 974 may not be configured to carry the electrical power, the sliding contact devices 984, 990 may be coupled to the set of wires 340*c* to deliver the electrical power, data signals (e.g., video signals, audio signals, audio/video signals, multimedia signals, etc.), control signals (e.g., analog or digital control signals), networking signals, and/or other suitable signals to the equipment coupled to the truss 100*c*.

In some aspects of the disclosure, one or more accessibility ports (e.g., accessibility ports 970, 971, 972) may be included in the truss 100*c*. In the example implementation of FIG. 9, the accessibility ports 970, 971, 972 may be included along the chord 108 to provide access to the electrical power, data signals (e.g., video signals, audio signals, audio/video signals, multimedia signals, etc.), control signals (e.g., analog or digital control signals), networking signals, and/or other suitable signals that may be transferred through the set of wires 340*c*. In some aspects of the disclosure, the accessibility port 971 may include a power connector 938 (e.g., an AC power outlet for a two or three prong plug), and female connectors 928, 930, 932, 934, and 936. For example, the female connector 928 may be an audio/video signal connector (e.g., a High-Definition Multimedia Interface (HDMI) connector), the female connector 930 may be an RJ45 jack (e.g., also referred to as an Ethernet cable connecter), and the female connector 932 may be a female XLR connector. In some aspects of the disclosure, the electrical power or data and/or control signals transferred through the male connectors 128*c*, 130*c*, 132*c*, 134*c*, 136*c*, and 138*c* of the connector interface 122*c* may be provided to the respective female connectors 928, 930, 932 934, 936, and 938 of the accessibility port 971.

Figure 10:
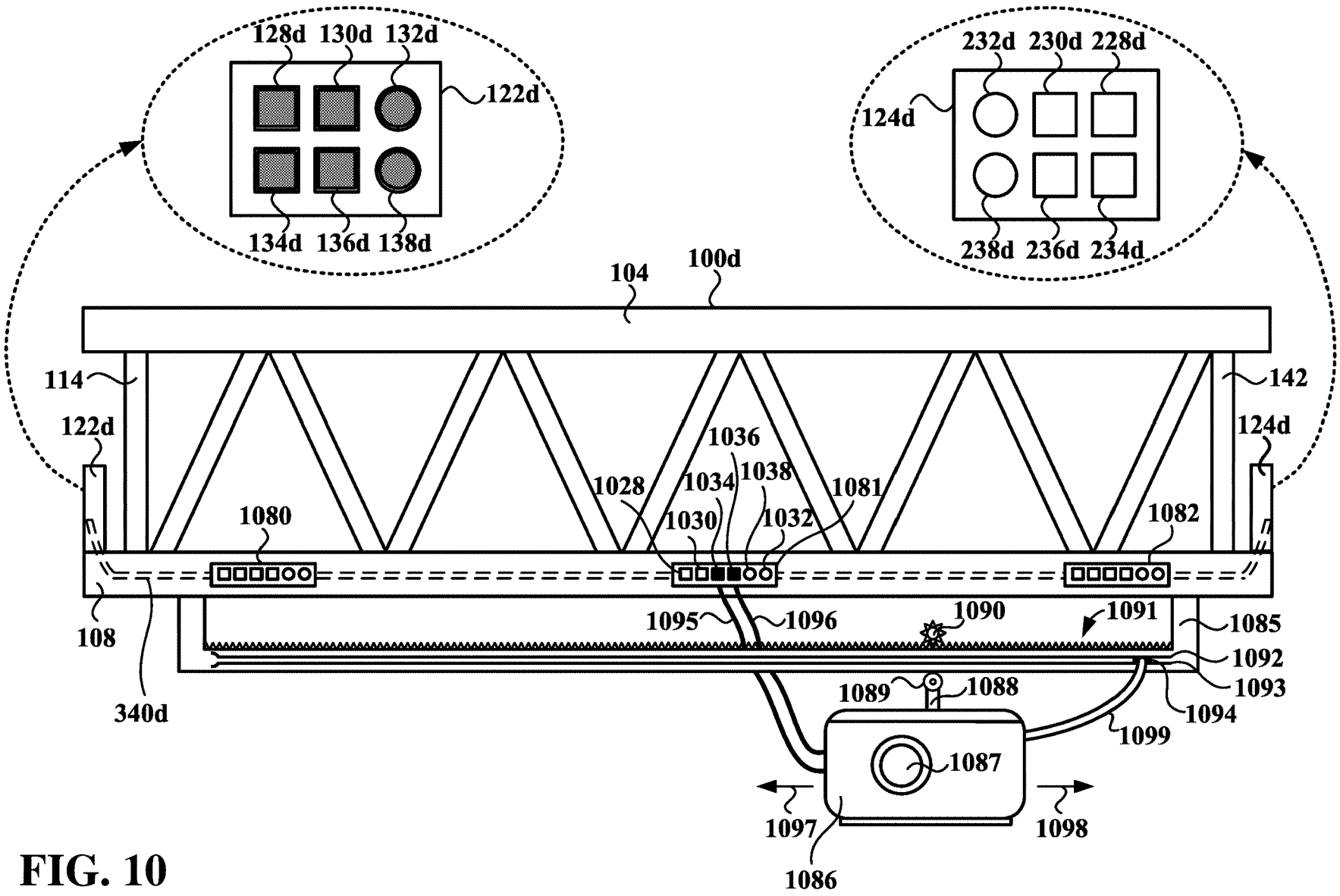
FIG. 10 is a side view of a truss with integrated wiring including an access rail and equipment in accordance with various aspects of the disclosure.

FIG. 10 is a side view of a truss 100*d* with integrated wiring including an access rail 1085 and equipment 1086 in accordance with various aspects of the disclosure. In FIG. 10, the set of connectors included in each of connector interfaces 122*d*, 124*d* are shown within dotted ovals above the truss 100*d* for reference. For example, and as shown in FIG. 10, the set of connectors of the connector interface 122*d* may include male connectors 128*d*, 130*d*, 132*d*, 134*d*, 136*d*, and 138*d*, and the set of connectors of the connector interface 124*d* may include corresponding female connectors 228*d*, 230*d*, 232*d*, 234*d*, 236*d*, and 238*d*. For example, the male connectors 128*d*, 130*d*, 132*d*, 134*d*, 136*d*, and 138*d* may be electrically coupled to the respective female connectors 228*d*, 230*d*, 232*d*, 234*d*, 236*d*, and 238*d* through a set of wires 340*d*.

As shown in FIG. 10, the access rail 1085 may be coupled to the chord 108 of the truss 100*d*. Although the access rail 1085 in FIG. 10 is shown to be installed below the chord 108, the access rail 1085 may be installed approximately level with the chord 108 in other implementations. In some aspects of the disclosure, the access rail 1085 may be coupled behind the chord 108. In one example implementation, the access rail 1085 may provide access to two parallel tracks 1092, 1093. In some aspects of the disclosure, the two parallel tracks 975, 976 may be conductive and configured for transferring the electrical power (e.g., the AC electrical power). In some aspects of the disclosure, the set of wires 340*d* may include wires designated as hot and neutral wires for transferring the electrical power. These hot and neutral wires may be accessed through an opening in the chord 108 and electrically coupled to the respective tracks 1092, 1093 of the access rail 1085. In one example, the male connector 138*d* may include contacts (e.g., a hot contact and a neutral contact) for receiving the electrical power. These contacts may be electrically coupled to the previously described wires designated as hot and neutral wires in the set of wires 340*d* to provide the electrical power to the access rail 1085.

As further shown in FIG. 10, the equipment 1086 may be mounted on the truss 100*d* using a mounting bracket 1088. In the example implementation of FIG. 10, the equipment 1086 may be video equipment (e.g., a media projector for projecting content, such as images or video, through a lens 1087 onto a projection screen (not shown)) that may operate on the AC electrical power. As shown in FIG. 10, a gear track 1091 may be included on the access rail 1085. As further shown in FIG. 10, the mounting bracket 1088 may include a motorized gear 1090 that engages the gear track 1091 and enables the equipment 1086 to move laterally (e.g., move in a first direction 1097 or a second direction 1098) along the gear track 1091. In some implementations, a roller 1089 may be included on the mounting bracket 1088 (e.g., positioned below the access rail 1085) to improve stability as the equipment 1086 moves along the gear track 1091.

In one example implementation, a cable 1099 (e.g., an electrical cable) may be coupled to the access rail 1085 (e.g., to the tracks 1092, 1093) to enable transfer of the electrical power and operation of the equipment 1086. As shown in the example implementation of FIG. 10, the cable 1099 may be electrically connected to a sliding contact device 1094. The sliding contact device 1094 may be inserted between the parallel tracks 1092, 1093 and may maintain contact with the parallel tracks 1092, 1093 as the sliding contact device 1094 slides along the access rail 1085. For example, when the equipment 1086 is moving in the first direction 1097 (e.g., toward the connector interface 122*d*), the sliding contact device 1094 may also move along the access rail 1085 in the same direction while continuously transferring the electrical power to the equipment 1086.

In some aspects of the disclosure, the two parallel tracks 1092, 1093 of the access rail 1085 may not be configured to carry the electrical power. In these aspects of the disclosure, the sliding contact device 1094 may be coupled to the set of wires 340*d* to deliver the electrical power, data signals (e.g., video signals, audio signals, audio/video signals, multimedia signals, etc.), control signals (e.g., analog or digital control signals), networking signals, and/or other suitable signals to the equipment 1094. For example, the electrical power, data signals, control signals, and/or networking signals may be transferred from the sliding contact device 1094 to the equipment 1086 through the cable 1099. Moreover, in these aspects of the disclosure, the cables 1095, 1096 described herein may not be coupled to the equipment 1086, thereby enabling free movement of the equipment 1086 while receiving the electrical power, data signals, control signals, and/or networking signals.

In some aspects of the disclosure, one or more accessibility ports (e.g., accessibility ports 1080, 1081, 1082) may be included in the truss 100*d*. In the example implementation of FIG. 10, the accessibility ports 1080, 1081, 1082 may be included along the chord 108 to provide access to the electrical power, data signals (e.g., video signals, audio signals, audiovisual signals, media signals, etc.), control signals (e.g., analog or digital control signals), networking signals, and/or other suitable signals that may be transferred through the set of wires 340*d*. In some aspects of the disclosure, the accessibility port 1081 may include a power connector 1038 (e.g., an AC power outlet for a two or three prong plug), and female connectors 1028, 1030, 1032, 1034, and 1036. For example, the female connector 1036 may be an audio/video signal connector (e.g., an HDMI connector), the female connector 1034 may be an RJ45 jack (e.g., also referred to as an Ethernet cable connecter), and the female connector 1032 may be a female XLR connector. In some aspects of the disclosure, the electrical power or data and/or control signals transferred through the male connectors 128*d*, 130*d*, 132*d*, 134*d*, 136*d*, and 138*d* of the connector interface 122*d* may be provided to the respective female connectors 1028, 1030, 1032 1034, 1036, and 1038 of the accessibility port 1081.

In some aspects of the disclosure, the equipment 1086 may be configured to receive content to be displayed through wireless signals (e.g., WiFi signals) and/or may be controlled via wireless control signals (e.g., infrared (IR) control signals, radio frequency (RF) control signals). For example, the wireless control signals may be transmitted from a remote control unit and may be configured to turn the equipment 1086 on and off, play or stop the content displayed by the equipment 1086, zoom in or out of the displayed content, and/or other suitable controls. In some aspects of the disclosure, the motorized gear 1090 enabling the equipment 1086 to move along the gear track 1091 may be controlled through wireless control signals (e.g., WiFi signals, Bluetooth signals, etc.).

In some aspects of the disclosure, and as shown in FIG. 10, the equipment 1086 may need to receive content and/or control signals for controlling the display of the content through a cable connection. For example, the equipment 1086 may be coupled to the female connector 1036 (e.g., an audio/video signal connector, such as an HDMI connector) via an audio/video signal cable 1096 (e.g., an HDMI cable) to receive content to be displayed. The equipment 1086 may be further coupled to the female connector 1034 (e.g., an Ethernet cable connector) via a network cable 1095 (e.g., an Ethernet cable) to receive control signals for controlling the display of content. In some aspects of the disclosure, the motorized gear 1090 enabling the equipment 1086 to move along the gear track 1091 may be controlled through control signals communicated to the equipment 1086 via the network cable 1095.

Figure 11:
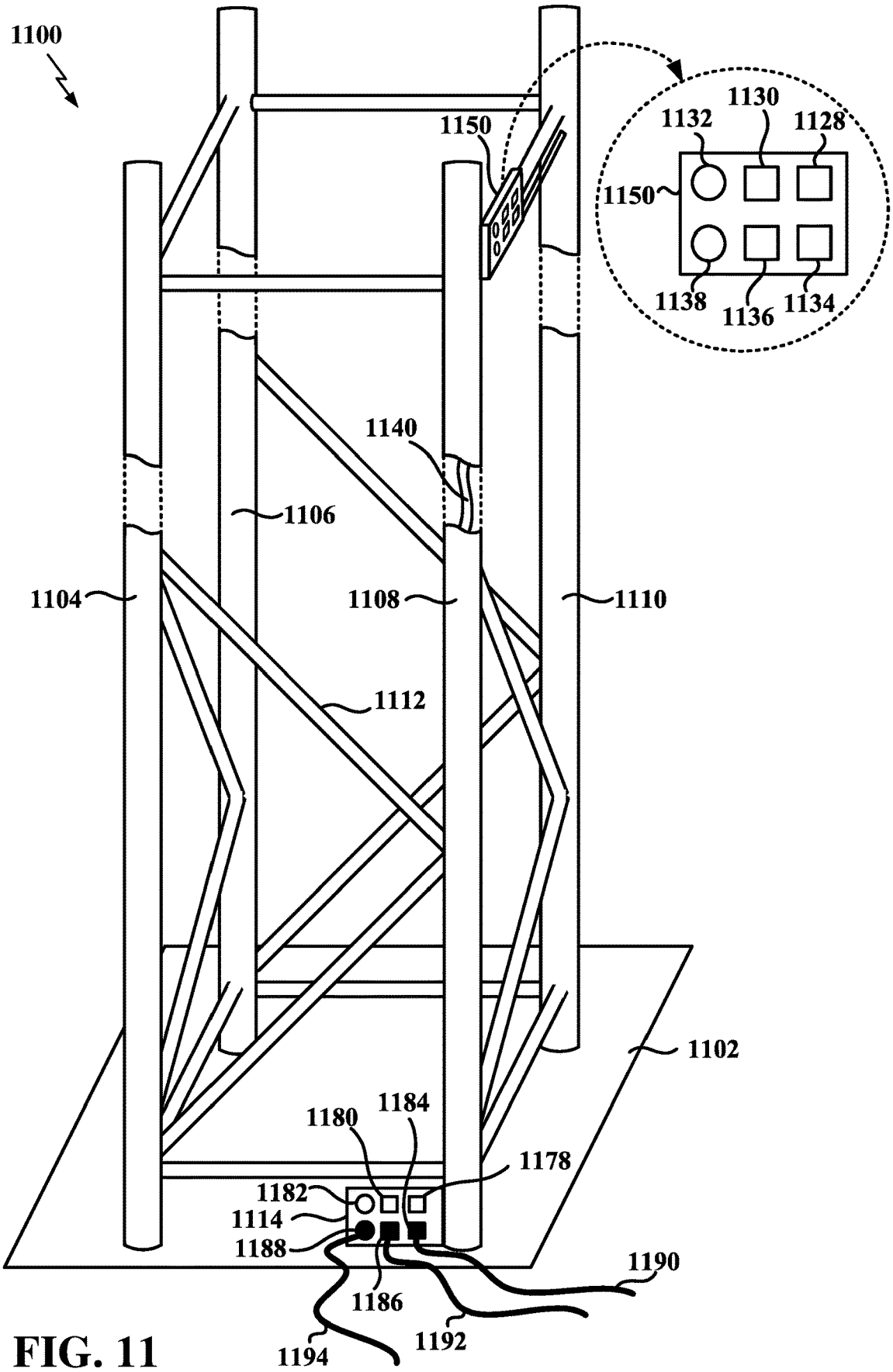
FIG. 11 illustrates a truss tower with integrated wiring in accordance with various aspects of the disclosure.

FIG. 11 illustrates a truss tower 1100 with integrated wiring in accordance with various aspects of the disclosure. As shown in FIG. 11, the truss tower 1100 may include chords 1104, 1106, 1108, 1110 and a number of support members coupled to the chords 1104, 1106, 1108, 1110, such as support member 1112. In some examples, the truss tower 1100 may be secured to the ground 1102 or a stable platform, such as a performance stage. In some aspects of the disclosure, the chords 1104, 1106, 1108, 1110 may be oriented substantially parallel with respect to one another. In some examples, each of the chords 1104, 1106, 1108, 1110 and each of the support members (e.g., the support member 1112) may have a tubular shape and may be formed using a rigid material, such as steel, aluminum, or other suitable material. In FIG. 11, for example, the chord 1108 may be a steel tube with a hollow space that extends along the length of the chord 1108.

As shown in FIG. 11, the truss tower 1100 may include an input/output interface 1114 situated at or near the bottom of the truss tower 1100. The truss tower 1100 may further include a connector interface 1150 including a set of connectors configured to mate with corresponding connectors of a truss with integrated wiring (e.g., truss 100, 100*a*, 100*b*, 100*c*, 100*d*). In some aspects of the disclosure, each of the connectors of the input/output interface 1114 may be electrically coupled to a corresponding female connector of the connector interface 1150 through a set of wires 1140 housed in the hollow space of the chord 1108. In some aspects of the disclosure, the chord 1108 may include holes (or other suitable openings) through a surface of the chord 1108 near the interfaces 1114, 1150. Such holes may be used to run the set of wires 1140 in/out of the hollow space of the chord 1108.

For example, each of connectors 1178, 1180, 1182, 1184, 1186, and 1188 of the input/output interface 1114 may be electrically coupled to respective female connectors 1128, 1130, 1132, 1134, 1136, and 1138 of the connector interface 1150. In some aspects of the disclosure, when forming a truss assembly (e.g., a truss assembly 1200 in FIG. 12), male connectors of a connector interface of a truss with integrated wiring as described herein may be electrically coupled with the corresponding female connectors 1128, 1130, 1132, 1134, 1136, and 1138 of the connector interface 1150. In one example, and with reference to FIG. 9, the male connectors 128*c*, 130*c*, 132*c*, 134*c*, 136*c*, and 138*c* of the connector interface 122*c* may mate with the respective female connectors 1128, 1130, 1132, 1134, 1136, and 1138 of the connector interface 1150 when the truss 100*c* is coupled to the truss tower 1100.

As described in detail with reference to FIG. 12, the input/output interface 1114 may be used to provide the electrical power (e.g., the AC electrical power), data signals, and/or control signals to the truss tower 1100 and other trusses with integrated wiring (e.g., truss 100, 100*a*, 100*b*, 100*c*, 100*d*) coupled to the truss tower 1100. In some example implementations, the connector 1188 may be configured for receiving the electrical power (e.g., the AC electrical power). For example, the connector 1188 may be a three prong power receptacle or inlet (e.g., an International Electrotechnical Commission (IEC) inlet). As shown in FIG. 11, a cable 1194 may be electrically coupled to the connector 1188 to transfer the electrical power (e.g., from a power receptacle, a portable electric generator, etc.) to the truss tower 1100. Accordingly, the electrical power may be transferred to the corresponding female connector 1138 of the connector interface 1150.

In some example implementations, the connector 1186 may be configured for receiving data signals. For example, the connector 1186 may be configured to receive digital audio/video signals (e.g., HDMI signals). In this example, the connector 1186 may be a female HDMI connector and a cable 1192 may be an HDMI cable that couples to the female HDMI connector. Accordingly, the data signals (e.g., audiovisual content) provided to the truss tower 1100 through the cable 1192 may be transferred to the corresponding female connector 1136 of the connector interface 1150.

In some example implementations, the connector 1184 may be configured for receiving control signals for controlling equipment coupled to the truss tower 1100. For example, the connector 1186 may be a female network connector (e.g., an Ethernet connector) configured to receive network signals and the cable 1190 may be a network cable (e.g., an Ethernet cable). For example, and as described in detail with reference to FIG. 12, the cable 1190 may provide control signals for controlling equipment coupled to the truss tower 1100. The control signals provided to the truss tower 1100 through the cable 1190 may be transferred to the corresponding female connector 1134 of the connector interface 1150.

Figure 12:
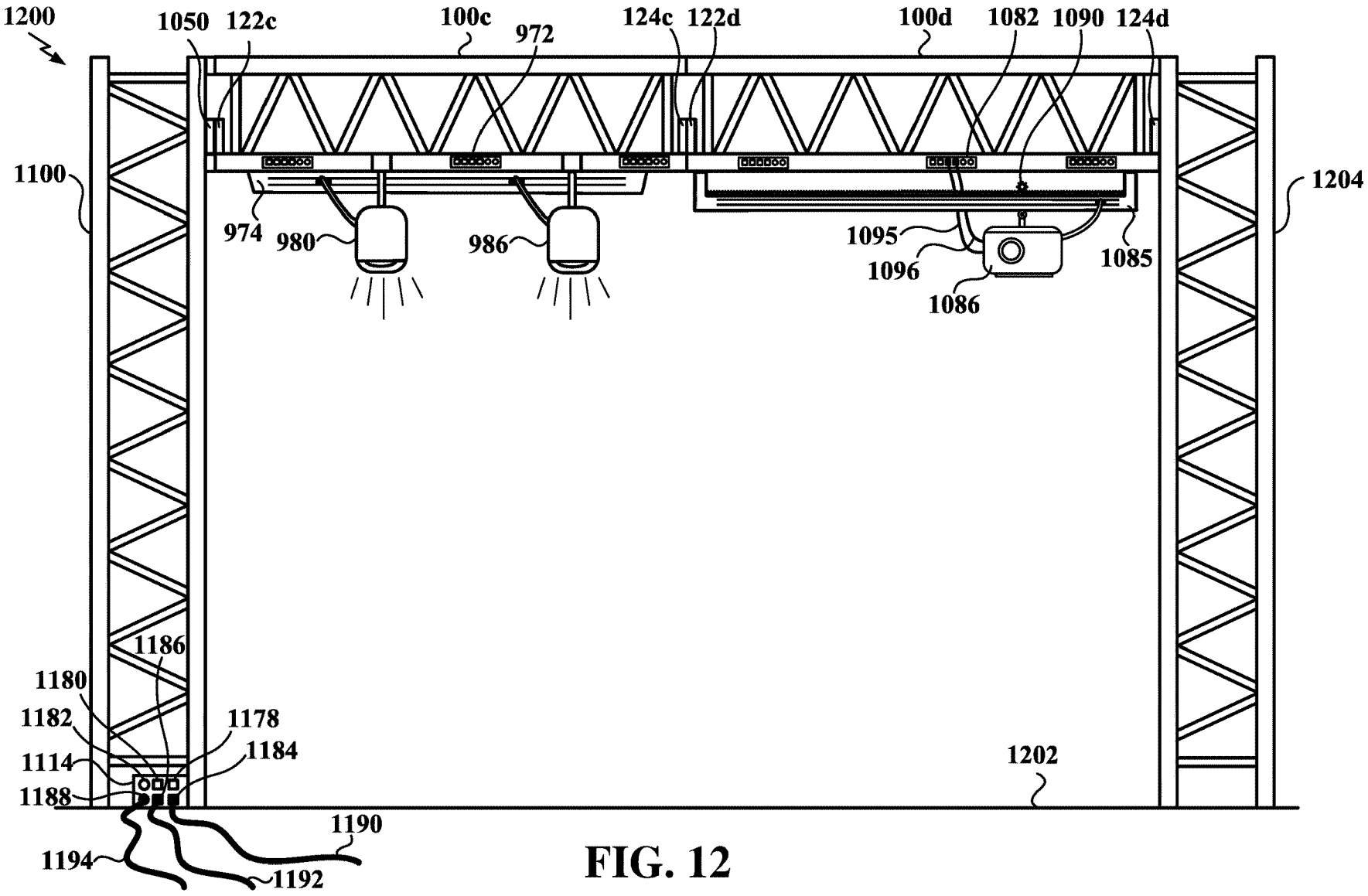
FIG. 12 shows a truss assembly with integrated wiring in accordance with various aspects of the disclosure.

FIG. 12 shows a truss assembly 1200 with integrated wiring in accordance with various aspects of the disclosure. The truss assembly 1200 may include a first truss tower with integrated wiring (e.g., the truss tower 1100 previously described with reference to FIG. 11), a second truss tower 1204, and trusses with integrated wiring (e.g., trusses 100*c*, 100*d*) coupled between the first and second truss towers 1100, 1204. As shown in FIG. 12, the first and second truss towers may be secured to the ground 1202 or a stable platform, such as a performance stage. As further shown in FIG. 12, the connector interface 122*c* of the truss 100*c* may be electrically coupled with the connector interface 1050 of the truss tower 1100. For example, the set of male connectors of the connector interface 122*c* (e.g., the male connectors 128*c*, 130*c*, 132*c*, 134*c*, 136*c*, 138*c*) may mate with corresponding female connectors (e.g., the female connectors 1128, 1130, 1132, 1134, 1136, and 1138) of the connector interface 1050. In addition, the connector interface 122*d* of the truss 100*d* may be electrically coupled to the connector interface 124*c* of the truss 100*c*. For example, the set of male connectors of the connector interface 122*d* (e.g., the male connectors 128*d*, 130*d*, 132*d*, 134*d*, 136*d*, 138*d*) may mate with the corresponding female connectors (e.g., the female connectors 228*c*, 230*c*, 232*c*, 234*c*, 236*c*, 238*c*) of the connector interface 124*c* similar to the configuration described with reference to FIG. 7.

In the example implementation of FIG. 12, the truss assembly 1200 may receive the electrical power through the cable 1194 and may transfer the electrical power to the first and second trusses 100*c*, 100*d* via the connector interface 1050. For example, the first truss 100*c* may transfer the electrical power received through the connector interface 122*c* to the access rail 974 and to at least one connector in each accessibility port (e.g., accessibility port 972) of the first truss 100*c*. The access rail 974 may then transfer the electrical power to the equipment 980, 986 coupled to the access rail 974. In addition, the first truss 100*c* may transfer the electrical power to the second truss 100*d* via the connector interface 124*c*. For example, the second truss 100*d* may transfer the electrical power received via the connector interfaces 124*c* and 122*d* to the access rail 1085 and to at least one connector in each accessibility port (e.g., accessibility port 1082) of the second truss 100*d*. The access rail 1085 may then transfer the electrical power to the equipment 1086 coupled to the access rail 1085.

In FIG. 12, data signals (e.g., digital data including content to be displayed on a projection screen) provided through the cable 1192 may be transferred to the equipment 1086 through the audio/video signal cable 1096 (e.g., an HDMI cable). Moreover, control signals (e.g., for controlling the display of the audiovisual content) provided through the cable 1190 (e.g., an Ethernet cable) may be transferred to the equipment 1086 through the network cable 1095 (e.g., an Ethernet cable). In some aspects of the disclosure, control signals provided through the cable 1190 for controlling the motorized gear 1090 (e.g., to laterally move the equipment 1086 along the access rail 1085) may be transferred to the equipment 1086 through the network cable 1095. Therefore, in scenarios where the position of the equipment 1086 on the access rail 1085 needs to be adjusted to project content within a specific area (e.g., a projection screen), the truss assembly 1200 may efficiently and conveniently achieve such adjustments through the control signals provided to the input/output interface 1114 at the base of the truss tower 1100.

In the aspects described herein, a truss with integrated wiring (e.g., the truss 100, 100*a*, 100*b*, 100*c*, 100*d*) may include four chords (also referred to as a box truss configuration). In other aspects of the disclosure, a truss with integrated wiring may be implemented using a different number of chords. For example, a truss with integrated wiring may be implemented using two chords (also referred to as a ladder truss configuration) or using three chords (also referred to as a triangular truss configuration).

Figure 13:
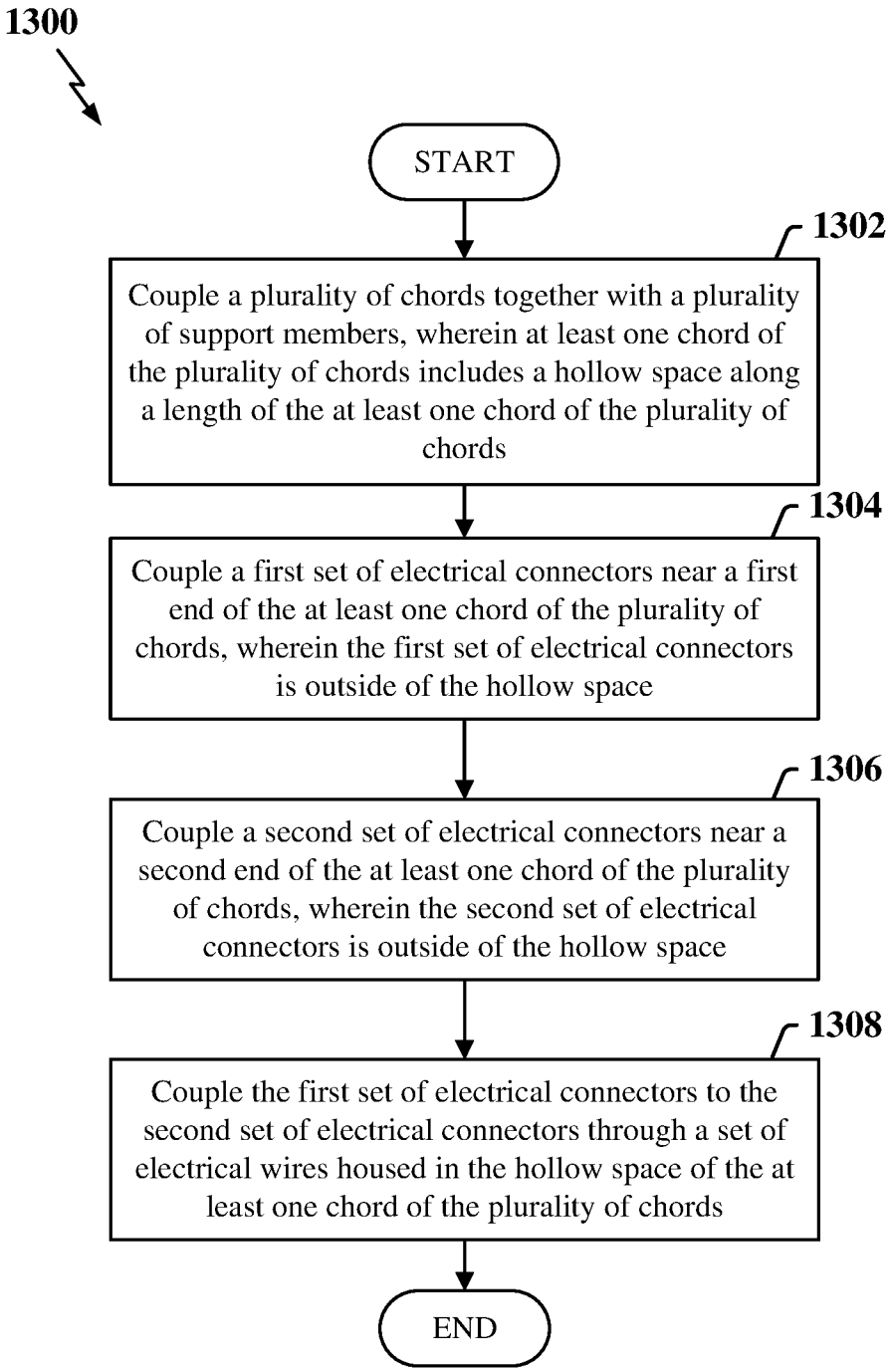
FIG. 13 is a flow chart illustrating an exemplary process for constructing a truss with integrated wiring in accordance with various aspects of the disclosure.

FIG. 13 is a flow chart illustrating an exemplary process 1300 for constructing a truss with integrated wiring. In some examples, the process 1300 may be carried out by any suitable apparatus or means for carrying out the operations described below.

At block 1302, the process involves coupling a plurality of chords together with a plurality of support members. At least one chord of the plurality of chords includes a hollow space along a length of the at least one chord of the plurality of chords.

At block 1304, the process involves coupling a first set of electrical connectors near a first end of the at least one chord of the plurality of chords. The first set of electrical connectors is outside of the hollow space.

At block 1306, the process involves coupling a second set of electrical connectors near a second end of the at least one chord of the plurality of chords. The second set of electrical connectors is outside of the hollow space.

At block 1308, the process involves coupling the first set of electrical connectors to the second set of electrical connectors through a set of electrical wires housed in the hollow space of the at least one chord of the plurality of chords.

Therefore, trusses with integrated wiring (e.g., the truss 100, 100*a*, 100*b*, 100*c*, 100*d*) and/or truss assemblies with integrated wiring (e.g., the truss assembly 1200) as described herein may avoid or reduce the need for long and heavy cables that are often required for powering and/or controlling equipment mounted to truss assemblies. For example, the set of wires (e.g., the set of wires 340*c*, 340*d*) housed within each truss (e.g., the truss 100*c*, 100*d*) may be efficiently and conveniently coupled together (e.g., via connector interfaces) as the trusses with integrated wiring are connected together to form a truss assembly (e.g., the truss assembly 1200). Accordingly, the truss assembly with integrated wiring may include uninterrupted conductive paths (e.g., the set of wires 1140, 340*c*, 340*d* coupled together through the connector interfaces 1050, 122*c*, 124*c*, 122*d*) for transferring the electrical power, data signals, and/or control signals to equipment mounted at various locations on the truss assembly. For example, adjustments to some types of equipment (e.g., the equipment 980, 986, 1086) may easily be made from an input/output interface (e.g., the input/output interface 1114) installed at a convenient and accessible location (e.g., near the ground). In some examples, a rail (e.g., the access rail 974, 1085) may be coupled to a truss with integrated wiring to provide the electrical power or signal connection points without finite lengths, thereby simplifying planning and design efforts for the truss assembly.

In addition, the integrated wiring of the disclosed trusses with integrated wiring may provide a safer work environment by avoiding or reducing the need to install and/or adjust the lengthy and heavy cables typically required for conventional trusses and truss assemblies. Moreover, since the truss assembly (e.g., the truss assembly 1200) with integrated wiring described herein enables cable terminations (e.g., for the cables 1190, 1192, 1194) to occur at the ground level in some implementations, additional weight from excess cabling may be avoided.

Example Truss Assembly with Integrated Wiring

In an aspect of the disclosure, and with reference to FIGS. 9-12, a truss assembly (e.g., the truss assembly 1200) with integrated wiring may include a first truss (e.g., the truss 100*c*) including a first set of electrical connectors (e.g., the male connectors 128*c*, 130*c*, 132*c*, 134*c*, 136*c*, 138*c*) situated near a first end of the first truss and a second set of electrical connectors (e.g., the female connectors 228*c*, 230*c*, 232*c*, 234*c*, 236*c*, 238*c*) situated near a second end of the first truss, the first set of electrical connectors being electrically coupled to the second set of electrical connectors through a first set of electrical wires (e.g., the set of wires 340*c*) housed inside a chord of the first truss (e.g., the chord 108 of the truss 100*c*). The truss assembly (e.g., the truss assembly 1200) with integrated wiring may further include a second truss (e.g., the truss 100*d*) including a third set of electrical connectors (e.g., the male connectors 128*d*, 130*d*, 132*d*, 134*d*, 136*d*, 138*d*) situated near a first end of the second truss and a fourth set of electrical connectors (e.g., the female connectors 228*d*, 230*d*, 232*d*, 234*d*, 236*d*, 238*d*) situated near a second end of the second truss, the third set of connectors being electrically coupled to the fourth set of electrical connectors through a second set of electrical wires (e.g., the set of wires 340*d*) housed inside a chord of the second truss (e.g., the chord 108 of the truss 100*c*). The second end of the first truss may be coupled to the first end of the second truss, and the second set of electrical connectors (e.g., the female connectors 228*c*, 230*c*, 232*c*, 234*c*, 236*c*, 238*c*) may be electrically coupled to the third set of electrical connectors (e.g., the male connectors 128*d*, 130*d*, 132*d*, 134*d*, 136*d*, 138*d*).

In some aspects of the disclosure, the fourth set of electrical connectors (e.g., the female connectors 228*d*, 230*d*, 232*d*, 234*d*, 236*d*, 238*d*) are electrically coupled to the first set of electrical connectors (e.g., the male connectors 128*c*, 130*c*, 132*c*, 134*c*, 136*c*, 138*c*) through the first and second set of electrical wires (the sets of wires 340*c*, 340*d*) and via the coupling of the second set of electrical connectors and the third set of electrical connectors.

In some aspects of the disclosure, a truss tower (e.g., the truss tower 1100 with integrated wiring) including a fifth set of electrical connectors (e.g., the female connectors 1128, 1130, 1132, 1134, 1136, and 1138 of the connector interface 1150) situated near a top of the truss tower and an input/output interface (e.g., the input/output interface 1114) containing a sixth set of electrical connectors, the fifth set of electrical connectors being coupled to the sixth set of electrical connectors of the input/output interface through a third set of electrical wires (e.g., the set of electrical wires 1140) housed inside a chord of the truss tower. The first end of the first truss may be coupled to the truss tower, and the first set of electrical connectors is coupled to the fifth set of electrical connectors.

In some aspects of the disclosure, the truss assembly further includes a second truss tower (e.g., the truss tower 1204). The second end of the second truss may be coupled to the second truss tower, and the first and second trusses may be substantially parallel to a ground (e.g., the ground 1202) and may be elevated above the ground.

In some aspects of the disclosure, the first set of electrical connectors (e.g., the male connectors 128*c*, 130*c*, 132*c*, 134*c*, 136*c*, 138*c*) includes at least a first power connector (e.g., the power connector 138*c*), the second set of electrical connectors includes at least a second power connector (e.g., the power connector 238*c*), the third set of electrical connectors includes at least a third power connector (e.g., the power connector 138*d*), and the fourth set of electrical connectors includes at least a fourth power connector (e.g., the power connector 238*d*), wherein the at least the first, second, third, and fourth power connectors enable transfer of an electrical power through the first and second trusses via the first and second set of electrical wires.

In some aspects of the disclosure, the electrical power may be provided to at least a fifth power connector (e.g., the power connector 1188) in the sixth set of electrical connectors of the input/output interface and transferred to the at least the first power connector of the first truss via at least a sixth power connector (e.g., the power connector 1138) in the fifth set of electrical connectors situated near the top of the truss tower. The electrical power may be transferred to at least one equipment (e.g., the equipment 980, 986, and/or 1086) coupled to the first or second truss with integrated wiring.

In some aspects of the disclosure, the first set of electrical connectors (e.g., the male connectors 128*c*, 130*c*, 132*c*, 134*c*, 136*c*, 138*c*) may include a first connector (e.g., male connector 136*c*) configured to transfer at least a data signal or a control signal, the second set of electrical connectors (e.g., the female connectors 228*c*, 230*c*, 232*c*, 234*c*, 236*c*, 238*c*) may include a second connector (e.g., male connector 236*c*) configured to transfer at least the data signal or the control signal, the third set of electrical connectors (e.g., the male connectors 128*d*, 130*d*, 132*d*, 134*d*, 136*d*, 138*d*) may include a third connector (e.g., male connector 136*d*) configured to transfer at least the data signal or the control signal, and the fourth set of electrical connectors (e.g., the male connectors 228*d*, 230*d*, 232*d*, 234*d*, 236*d*, 238*d*) may include a fourth connector (e.g., the male connector 236*d*) configured to transfer at least the data signal or the control signal, wherein the first, second, third, and fourth connectors enable transfer of the data signal or the control signal through the first and second trusses via the first and second set of electrical wires (the set of wires 340*c*, 340*d*).

In some aspects of the disclosure, the data signal or the control signal is provided to at least a fifth connector (e.g., the connector 1186) configured to transfer the data signal or the control signal in the sixth set of electrical connectors of the input/output interface (e.g., the input/output interface 1114), and wherein the data signal or the control signal is transferred to the first connector of the first truss via at least a sixth connector (e.g., the female connector 1136) configured to transfer the data signal or the control signal in the fifth set of electrical connectors situated near the top of the truss tower. The data signal or the control signal may be transferred to at least one equipment coupled to the first or second truss.

Within the present disclosure, the word "exemplary" is used to mean "serving as an example, instance, or illustration." Any implementation or aspect described herein as "exemplary" is not necessarily to be construed as preferred or advantageous over other aspects of the disclosure. Likewise, the term "aspects" does not require that all aspects of the disclosure include the discussed feature, advantage or mode of operation. The term "coupled" is used herein to refer to the direct or indirect coupling between two objects. For example, if object A physically touches object B, and object B touches object C, then objects A and C may still be considered coupled to one another—even if they do not directly physically touch each other. For instance, a first object may be coupled to a second object even though the first object is never directly physically in contact with the second object.

One or more of the components, steps, features and/or functions illustrated in FIGS. 1-13 may be rearranged and/or combined into a single component, step, feature or function or embodied in several components, steps, or functions. Additional elements, components, steps, and/or functions may also be added without departing from novel features disclosed herein. The apparatus, devices, and/or components illustrated in FIGS. 1-13 may be configured to perform one or more of the methods, features, or steps described herein. The novel algorithms described herein may also be efficiently implemented in software and/or embedded in hardware.

It is to be understood that the specific order or hierarchy of steps in the methods disclosed is an illustration of exemplary processes. Based upon design preferences, it is understood that the specific order or hierarchy of steps in the methods may be rearranged. The accompanying method claims present elements of the various steps in a sample order, and are not meant to be limited to the specific order or hierarchy presented unless specifically recited therein.

The previous description is provided to enable any person skilled in the art to practice the various aspects described herein. Various modifications to these aspects will be readily apparent to those skilled in the art, and the generic principles defined herein may be applied to other aspects. Thus, the claims are not intended to be limited to the aspects shown herein, but are to be accorded the full scope consistent with the language of the claims, wherein reference to an element in the singular is not intended to mean "one and only one" unless specifically so stated, but rather "one or more." Unless specifically stated otherwise, the term "some" refers to one or more. A phrase referring to "at least one of" a list of items refers to any combination of those items, including single members. As an example, "at least one of: a, b, or c" is intended to cover: a; b; c; a and b; a and c; b and c; and a, b and c. All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. § 112(f) unless the element is expressly recited using the phrase "means for" or, in the case of a method claim, the element is recited using the phrase "step for."

What is claimed is:

1. A truss with integrated wiring, comprising:

a plurality of chords coupled together with a plurality of support members, wherein at least one chord of the plurality of chords includes a hollow space along a length of the at least one chord of the plurality of chords;

a first set of electrical connectors situated near a first end of the at least one chord of the plurality of chords, wherein the first set of electrical connectors is outside of the hollow space; and a second set of electrical connectors situated near a second end of the at least one chord of the plurality of chords, wherein the second set of electrical connectors is outside of the hollow space, and wherein the first set of electrical connectors is electrically coupled to the second set of electrical connectors through a set of electrical wires housed in the hollow space, wherein no portion of the set of electrical wires is exposed, and wherein the first set of electrical connectors and the second set of electrical connectors are configured to mate with respective electrical connectors of an adjacent truss.

2. The truss of claim 1, wherein the first set of electrical connectors includes one or more male connectors.

3. The truss of claim 1, wherein the first set of electrical connectors includes at least a first power connector configured to transfer an electrical power, wherein the second set of electrical connectors includes at least a second power connector configured to transfer the electrical power, wherein the set of electrical wires includes a plurality of electrical wires configured for transferring the electrical power, and wherein the at least the first and second power connectors are electrically coupled through the plurality of electrical wires configured for transferring the electrical power.

4. The truss of claim 3, further comprising an access rail, wherein the access rail is coupled to the at least one chord of the plurality of chords and the plurality of electrical wires configured for transferring the electrical power.

5. The truss of claim 4, further comprising an equipment coupled to the truss, wherein the equipment is electrically coupled to the access rail.

6. The truss of claim 5, wherein the equipment is a lighting equipment, a video equipment, or an audio equipment.

7. The truss of claim 5, further comprising a gear track coupled to the access rail, wherein the equipment is coupled to a motorized gear configured to engage the gear track, the motorized gear enabling the equipment to move along the gear track while receiving the electrical power.

8. The truss of claim 1, wherein the first set of electrical connectors includes at least a first connector configured to transfer a data signal, and wherein the second set of electrical connectors includes at least a second connector configured to transfer the data signal.

9. The truss of claim 1, wherein the first set of electrical connectors includes at least a first connector configured to transfer a control signal, and wherein the second set of electrical connectors includes at least a second connector configured to transfer the control signal.

10. The truss of claim 1, wherein the at least one chord of the plurality of chords includes one or more accessibility ports along the length of the at least one chord of the plurality of chords, the one or more accessibility ports including a third set of electrical connectors of the truss, the third set of electrical connectors of the truss being coupled to the first set of electrical connectors via the set of electrical wires housed in the hollow space.

11. A truss assembly with integrated wiring comprising:

a first truss including a plurality of chords coupled together with a plurality of support members, wherein at least one chord of the plurality of chords includes a hollow space along a length of the at least one chord of the plurality of chords, the first truss further including a first set of electrical connectors situated outside of the hollow space and near a first end of the at least one chord of the plurality of chords of the first truss and a second set of electrical connectors situated outside of the hollow space and near a second end of the at least one chord of the plurality of chords of the first truss, the first set of electrical connectors being electrically coupled to the second set of electrical connectors through a first set of electrical wires housed inside the at least one chord of the first truss, and wherein no portion of the first set of electrical wires is exposed; and a second truss including a third set of electrical connectors situated near a first end of the second truss and a fourth set of electrical connectors situated near a second end of the second truss, the third set of electrical connectors being coupled to the fourth set of electrical connectors through a second set of electrical wires housed inside a chord of the second truss, wherein the second end of the first truss is coupled to the first end of the second truss, and wherein the second set of electrical connectors is coupled to the third set of electrical connectors.

12. The truss assembly of claim 11, wherein the fourth set of electrical connectors are coupled to the first set of electrical connectors through the first and second set of electrical wires and via the coupling of the second set of electrical connectors and the third set of electrical connectors.

13. The truss assembly of claim 11, further comprising:

a truss tower including a fifth set of electrical connectors situated near a top of the truss tower and an input/output interface containing a sixth set of electrical connectors, the fifth set of electrical connectors being coupled to the sixth set of electrical connectors of the input/output interface through a third set of electrical wires housed inside a chord of the truss tower, wherein the first end of the first truss is coupled to the truss tower, and the first set of electrical connectors is coupled to the fifth set of electrical connectors.

14. The truss assembly of claim 13, further comprising:

a second truss tower, wherein the second end of the second truss is coupled to the second truss tower, and wherein the first and second trusses are substantially parallel to a ground and elevated above the ground.

15. The truss assembly of claim 13, wherein the first set of electrical connectors includes at least a first power connector, the second set of electrical connectors includes at least a second power connector, the third set of electrical connectors includes at least a third power connector, and the fourth set of electrical connectors includes at least a fourth power connector, wherein the at least the first, second, third, and fourth power connectors enable transfer of an electrical power through the first and second trusses via the first and second set of electrical wires.

16. The truss assembly of claim 15, wherein the electrical power is provided to at least a fifth power connector in the sixth set of electrical connectors of the input/output interface and transferred to the at least the first power connector of the first truss via at least a sixth power connector in the fifth set of electrical connectors situated near the top of the truss tower, and wherein the electrical power is transferred to at least one equipment coupled to the first or second truss.

17. The truss assembly of claim 13, wherein the first set of electrical connectors includes a first connector configured to transfer at least a data signal or a control signal, the second set of electrical connectors includes a second connector configured to transfer at least the data signal or the control signal, the third set of electrical connectors includes a third connector configured to transfer at least the data signal or the control signal, and the fourth set of electrical connectors includes a fourth connector configured to transfer at least the data signal or the control signal, wherein the first, second, third, and fourth connectors enable transfer of the data signal or the control signal through the first and second trusses via the first and second set of electrical wires.

18. The truss assembly of claim 17, wherein the data signal or the control signal is provided to at least a fifth connector configured to transfer the data signal or the control signal in the sixth set of electrical connectors of the input/output interface, and wherein the data signal or the control signal is transferred to the first connector of the first truss via at least a sixth connector configured to transfer the data signal or the control signal in the fifth set of electrical connectors situated near the top of the truss tower, and wherein the data signal or the control signal is transferred to at least one equipment coupled to the first or second truss.

19. A method for constructing a truss with integrated wiring, the method comprising:

coupling a plurality of chords together with a plurality of support members, wherein at least one chord of the plurality of chords includes a hollow space along a length of the at least one chord of the plurality of chords;

coupling a first set of electrical connectors near a first end of the at least one chord of the plurality of chords, wherein the first set of electrical connectors is outside of the hollow space;

coupling a second set of electrical connectors near a second end of the at least one chord of the plurality of chords, wherein the second set of electrical connectors is outside of the hollow space; and coupling the first set of electrical connectors to the second set of electrical connectors through a set of electrical wires housed in the hollow space of the at least one chord of the plurality of chords, wherein no portion of the set of electrical wires is exposed, and wherein the first set of electrical connectors and the second set of electrical connectors are configured to mate with respective electrical connectors of adjacent trusses.

* * * * *